US011657750B2

(12) United States Patent
Wang et al.

(10) Patent No.: US 11,657,750 B2
(45) Date of Patent: May 23, 2023

(54) DISPLAY SUBSTRATE AND DISPLAY PANEL

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Yu Wang, Beijing (CN); Yi Zhang, Beijing (CN); Tingliang Liu, Beijing (CN); Chang Luo, Beijing (CN); Tinghua Shang, Beijing (CN); Huijuan Yang, Beijing (CN); Yang Zhou, Beijing (CN); Pengfei Yu, Beijing (CN); Shun Zhang, Beijing (CN); Linhong Han, Beijing (CN); Meng Zhang, Beijing (CN); Hao Zhang, Beijing (CN); Xiaofeng Jiang, Beijing (CN); Huijun Li, Beijing (CN); Yupeng He, Beijing (CN); Xin Zhang, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 232 days.

(21) Appl. No.: 17/289,705

(22) PCT Filed: Jul. 8, 2020

(86) PCT No.: PCT/CN2020/100798

§ 371 (c)(1),
(2) Date: Apr. 28, 2021

(87) PCT Pub. No.: WO2022/006769

PCT Pub. Date: Jan. 13, 2022

(65) Prior Publication Data

US 2022/0189377 A1 Jun. 16, 2022

(51) Int. Cl.
*G09G 3/20* (2006.01)

(52) U.S. Cl.
CPC ... *G09G 3/2074* (2013.01); *G09G 2310/0272* (2013.01); *G09G 2310/0286* (2013.01); *G09G 2330/028* (2013.01)

(58) Field of Classification Search
CPC ..... G09G 2/2074; G09G 2310/0272; G09G 2310/0286; G09G 2330/028
See application file for complete search history.

(56) References Cited

U.S. PATENT DOCUMENTS 9,262,952 B2 2/2016 Kim et al.
9,595,213 B2 3/2017 Kim
(Continued)

FOREIGN PATENT DOCUMENTS

CN 104217671 A 12/2014
CN 104217672 A 12/2014
(Continued)

*Primary Examiner* — Ricardo Osorio
(74) *Attorney, Agent, or Firm* — Kinney & Lange, P.A.

(57) ABSTRACT

A display substrate and a display panel are disclosed. The display substrate includes a base substrate having an active area and a peripheral area surrounding the active area; a plurality of sub-pixels, in the active area; a plurality of first pins and a plurality of second pins located in the peripheral area; a plurality of first array test pins located between the plurality of first pins and the plurality of second pins and respectively electrically coupled to a plurality of array test signal lines; and a plurality of second array test pins located between the plurality of first pins and the plurality of second pins and extending in a direction along a boundary of the active area, wherein the plurality of first array test pins are located on at least one side of the plurality of second array test pins in the direction along the boundary of the active area.

20 Claims, 26 Drawing Sheets

(56) References Cited

U.S. PATENT DOCUMENTS

| | | | | |
|---|---|---|---|---|
| 10,311,765 | B2 | 6/2019 | Hao et al. | |
| 2009/0219035 | A1 | 9/2009 | Apte | |
| 2014/0354285 | A1 | 12/2014 | Kim et al. | |
| 2014/0354286 | A1 * | 12/2014 | Kim | G09G 3/3225 324/414 |
| 2018/0218657 | A1 | 8/2018 | Hao et al. | |

FOREIGN PATENT DOCUMENTS

| | | | | | |
|---|---|---|---|---|---|
| CN | 106057109 | A | | 10/2016 | |
| CN | 206040646 | U | | 3/2017 | |
| CN | 107103869 | A | * | 8/2017 | |
| CN | 108400101 | A | | 8/2018 | |
| CN | 109830199 | A | | 5/2019 | |
| CN | 110286536 | A | | 9/2019 | |
| CN | 111128063 | B | * | 3/2021 | G09G 3/006 |

* cited by examiner

DISPLAY SUBSTRATE AND DISPLAY PANEL

CROSS-REFERENCE TO RELATED APPLICATION(S)

This application is a Section 371 National Stage Application of International Application No. PCT/CN2020/100798, filed on Jul. 8, 2020, entitled "DISPLAY SUBSTRATE, MANUFACTURING METHOD THEREOF, AND DISPLAY PANEL", which is incorporated herein by reference in its entirety.

TECHNICAL FIELD

The present disclosure relates to the field of display technology, in particular to a display substrate and a display panel.

BACKGROUND

Generally, various tests are performed during a manufacturing process of a display panel or after the manufacturing is completed, for example, an array test is performed on an array substrate of the display panel to ensure product quality.

SUMMARY

The present disclosure provides a display substrate, including:

a base substrate including an active area and a peripheral area surrounding the active area;

a plurality of sub-pixels located in the active area;

a plurality of data lines located in the active area and extending in a first direction, wherein the plurality of data lines are electrically coupled to the plurality of sub-pixels;

a plurality of gate lines located in the active area and extending in a second direction, wherein the first direction intersects the second direction, and the plurality of gate lines are electrically coupled to the plurality of sub-pixels;

a gate driving circuit located in the peripheral area, and electrically coupled to the plurality of gate lines;

a first start-up voltage signal line, a first clock signal line, and a second clock signal line electrically coupled to the gate driving circuit;

a plurality of first pins located in the peripheral area;

a plurality of second pins located in the peripheral area and between the active area and the plurality of first pins;

a plurality of first array test pins located between the plurality of first pins and the plurality of second pins, wherein the plurality of first array test pins are electrically coupled respectively to a plurality of array test signal lines, and the plurality of array test signal lines include at least one of the first start-up voltage signal line, the first clock signal line, or the second clock signal line; and a plurality of second array test pins located between the plurality of first pins and the plurality of second pins and arranged in a direction along a boundary of the active area, wherein the plurality of first array test pins are located on at least one side of the plurality of second array test pins in the direction along the boundary of the active area, the plurality of second array test pins are electrically coupled to the plurality of data lines, and the plurality of the second array test pins are configured to receive array test data signals from the plurality of sub-pixels through the plurality of data lines.

In an example, the plurality of array test signal lines include the first start-up voltage signal line, the first clock signal line, and the second clock signal line.

In an example, the active area includes a first boundary, a second boundary, a third boundary, and a fourth boundary coupled in sequence, and the plurality of first array test pins and the plurality of second array test pins are located in the peripheral area close to the first boundary;

the gate driving circuit includes a first sub-circuit and a second sub-circuit, the first sub-circuit is located in the peripheral area close to the second boundary and the second sub-circuit is located in the peripheral area close to the fourth boundary;

the first start-up voltage signal line includes a first sub-line of first start-up voltage signal line and a second sub-line of first start-up voltage signal line; the first clock signal line includes a first sub-line of first clock signal line and a second sub-line of first clock signal line; the second clock signal line includes a first sub-line of second clock signal line and a second sub-line of second clock signal line; the first sub-line of first start-up voltage signal line, the first sub-line of first clock signal line and the first sub-line of second clock signal line are located in the peripheral area close to the second boundary, and are electrically coupled to the first sub-circuit; and the second sub-line of first start-up voltage signal line, the second sub-line of first clock signal line, and the second sub-line of second clock signal line are located in the peripheral area close to the fourth boundary, and are electrically coupled to the second sub-circuit;

the plurality of first array test pins includes a first group of first array test pins and a second group of first array test pins, and the first group of first array test pins and the second group of first array test pins are located respectively on both sides of the plurality of second array test pins in a direction along the first boundary; and wherein, the first sub-line of first start-up voltage signal line, the first sub-line of first clock signal line, and the first sub-line of second clock signal line are electrically coupled to the first group of first array test pins, and the second sub-line of first start-up voltage signal line, the second sub-line of first clock signal line, and the second sub-line of second clock signal line are electrically coupled to the second group of first array test pins.

In an example, the display substrate further includes:

a plurality of light-emitting control lines located in the active area and extending in the second direction, the plurality of light-emitting control lines are electrically coupled to the plurality of sub-pixels;

a light-emitting control driving circuit located in the peripheral area and on a side of the gate driving circuit away from the active area;

a second start-up voltage signal line, a third clock signal line, and a fourth clock signal line, wherein the light-emitting control driving circuit is electrically coupled to the second start-up voltage signal line, the third clock signal line, and the fourth clock signal line, and the plurality of array test signal lines further include at least one of the second start-up voltage signal line, the third clock signal line, or the fourth clock signal line.

In an example, the plurality of array test signal lines further include the second start-up voltage signal line, the third clock signal line, and the fourth clock signal line.

In an example, the active area includes a first boundary, a second boundary, a third boundary, and a fourth boundary coupled in sequence, and the plurality of first array test pins and the plurality of second array test pins are located in the peripheral area close to the first boundary;

the light-emitting control driving circuit includes a third sub-circuit and a fourth sub-circuit, the third sub-circuit is located in the peripheral area close to the second boundary and the fourth sub-circuit is located in the peripheral area close to the fourth boundary;

the second start-up voltage signal line includes a first sub-line of second start-up voltage signal line and a second sub-line of second start-up voltage signal line; the third clock signal line includes a first sub-line of third clock signal line and a second sub-line of third clock signal line; and the fourth clock signal line includes a first sub-line of fourth clock signal line and a second sub-line of fourth clock signal line;

the first sub-line of second start-up voltage signal line, the first sub-line of third clock signal line, and the first sub-line of fourth clock signal line are located in the peripheral area close to the second boundary, and are electrically coupled to the third sub-circuit; and the second sub-line of second start-up voltage signal line, the second sub-line of third clock signal line, and the second sub-line of fourth clock signal line are located in the peripheral area close to the fourth boundary, and are electrically coupled to the fourth sub-circuit;

the plurality of first array test pins includes a first group of first array test pins and a second group of first array test pins, and the first group of first array test pins and the second group of first array test pins are located respectively on both sides of the plurality of second array test pins; and wherein, the first sub-line of second start-up voltage signal line, the first sub-line of third clock signal line, and the first sub-line of fourth clock signal line are electrically coupled to the first group of first array test pins, and the second sub-line of second start-up voltage signal line, the second sub-line of third clock signal line, and the second sub-line of fourth clock signal line are electrically coupled to the second group of first array test pins.

In an example, the display substrate further includes:

a first selection signal line and a second selection signal line; and a multiplex circuit located between the plurality of second pins and the active area, wherein the multiplex circuit includes a plurality of multiplex switches, at least one of the plurality of multiplex switches includes a first transistor and a second transistor, a gate of the first transistor is electrically coupled to the first selection signal line, and a gate of the second transistor is electrically coupled to the second selection signal line; and wherein, the plurality of array test signal lines further include the first selection signal line and the second selection signal line.

In an example, the first selection signal line includes a first sub-line of first selection signal line and a second sub-line of first selection signal line, and the second selection signal line includes a first sub-line of second selection signal line and a second sub-line of second selection signal line;

the plurality of first array test pins include a first group of first array test pins and a second group of first array test pins, and the first group of first array test pins and the second group of first array test pins are located respectively on both sides of the plurality of second array test pins; and wherein, the first sub-line of first selection signal line and the first sub-line of second selection signal line are electrically coupled to the first group of first array test pins, and the second sub-line of first selection signal line and the second sub-line of second selection signal line are electrically coupled to the second group of first array test pins.

In an example, the display substrate further includes:

a plurality of initial voltage signal lines located in the active area and an initial voltage signal bus located in the peripheral area, wherein the initial voltage signal bus is located between the gate driving circuit and the active area, and the plurality of array test signal lines further include the initial voltage signal bus.

In an example, the initial voltage signal bus includes a first sub-line of initial voltage signal bus and a second sub-line of initial voltage signal bus, the first sub-line of initial voltage signal bus is located in the peripheral area close to the second boundary and the second sub-lines of initial voltage signal bus is located in the peripheral area close to the fourth boundary;

the plurality of first array test pins includes a first group of first array test pins and a second group of first array test pins, and the first group of first array test pins and the second group of first array test pins are located respectively on both sides of the plurality of second array test pins; and wherein, the first sub-line of initial voltage signal bus is electrically coupled to the first group of first array test pins, and the second sub-line of initial voltage signal bus is electrically coupled to the second group of first array test pins.

In an example, the display substrate further includes:

a plurality of first power lines located in the active area and a first power bus located in the peripheral area close to the first boundary, wherein the plurality of first power lines are electrically coupled to the first power bus, and the plurality of array test signal lines further include the first power bus.

In an example, the first power bus includes a first sub-line of first power bus and a second sub-line of first power bus, and the first sub-line of first power bus and the second sub-line of first power bus are located respectively in the peripheral area close to the first boundary;

the plurality of first array test pins includes a first group of first array test pins and a second group of first array test pins, and the first group of first array test pins and the second group of first array test pins are located respectively on both sides of the plurality of second array test pins; and wherein, the first sub-line of first power bus is electrically coupled to the first group of first array test pins, and the second sub-line of first power bus is electrically coupled to the second group of first array test pins.

In an example, the display substrate further includes:

a first switch signal line, a second switch signal line, a third switch signal line, and a fourth switch signal line;

a first cell test circuit located between the plurality of second pins and the active area, wherein the first cell test circuit includes a plurality of first test sub-circuits, at least one of the plurality of first test sub-circuits includes a third transistor, a fourth transistor, and a fifth transistor, and wherein a gate of the third transistor is electrically coupled to the first switch signal line, a gate of the fourth transistor is electrically coupled to the second switch signal line, and a gate of the fifth transistor is electrically coupled to the third switch signal line;

a second cell test circuit located between the plurality of second pins and the first cell test circuit, wherein the second cell test circuit includes a plurality of second test sub-circuits, at least one of the plurality of second test sub-circuits includes a sixth transistor, and a gate of the sixth transistor is electrically coupled to the fourth switch signal line; and wherein, the plurality of array test signal lines further include at least one of the first switch signal line, the second switch signal line, the third switch signal line, or the fourth switch signal line.

In an example, the plurality of array test signal lines further include the first switch signal line, the second switch signal line, the third switch signal line, and the fourth switch signal line.

In an example, the first switch signal line includes a first sub-line of first switch signal line and a second sub-line of first switch signal line, the second switch signal line includes a first sub-line of second switch signal line and a second sub-line of second switch signal line, the third switch signal line includes a first sub-line of third switch signal line and a second sub-line of third switch signal line, and the fourth switch signal line includes a first sub-line of fourth switch signal line and a second sub-line of fourth switch signal line;

the plurality of first array test pins includes a first group of first array test pins and a second group of first array test pins, and the first group of first array test pins and the second group of first array test pins are located respectively on both sides of the plurality of second array test pins; and the first sub-line of first switch signal line, the first sub-line of second switch signal line, the first sub-line of third switch signal line, and the first sub-line of fourth switch signal line are electrically coupled to the first group of first array test pins, and the second sub-line of first switch signal line, the second sub-line of second switch signal line, the second sub-line of third switch signal line and the second sub-line of fourth switch signal line are electrically coupled to the second group of first array test pins.

In an example, at least a part of the plurality of array test signal lines are coupled in one-to-one correspondence with a part of the plurality of second pins, and the part of the plurality of second pins are coupled in one-to-one correspondence with at least a part of the plurality of first array test pins through a plurality of first connection lines.

In an example, the at least a part of the plurality of array test signal lines include the first start-up voltage signal line, the first clock signal line, the second clock signal line, a second start-up voltage signal line, a third clock signal line, a fourth clock signal line, a first selection signal line, a second selection signal line, and an initial voltage signal bus.

In an example, the other part of the plurality of array test signal lines are coupled in one-to-one correspondence with the other part of the plurality of first array test pins through a plurality of second connection lines.

In an example, the other part of the plurality of array test signal lines include a first switch signal line, a second switch signal line, a third switch signal line, a fourth switch signal line, and a first power bus.

In an example, the display substrate further includes an electrostatic discharge circuit, wherein the electrostatic discharge circuit includes a plurality of electrostatic discharge units located between the plurality of first array test pins and the plurality of second pins and coupled in one-to-one correspondence with the plurality of first array test pins; wherein each of the electrostatic discharge units includes a seventh transistor and an eighth transistor, a gate and a first electrode of the seventh transistor are coupled to a high voltage signal line, a second electrode of the eighth transistor is coupled to a low voltage signal line, and a second electrode of the seventh transistor and a gate and a first electrode of the eighth transistor are electrically coupled to the first array test pins.

In an example, the plurality of first array test pins and the plurality of second array test pins are arranged in one or more rows in the direction along the boundary of the active area.

In an example, at least one of the plurality of sub-pixels includes a driving thin film transistor and a storage capacitor;

the driving thin film transistor includes a driving active layer located on the base substrate, a driving gate located on a side of the driving active layer away from the base substrate, a gate insulating layer located on a side of the driving gate away from the base substrate, an interlayer dielectric layer located on a side of the gate insulating layer away from the base substrate, and a driving source and a driving drain located on a side of the interlayer dielectric layer away from the base substrate;

the storage capacitor includes a first capacitor electrode and a second capacitor electrode, the first capacitor electrode is located in the same layer as the driving gate, and the second capacitor electrode is located between the gate insulating layer and the interlayer dielectric layer; and at least one layer of the plurality of first array test pins and the plurality of second array test pins is located in the same layer as driving sources and driving drains of the plurality of sub-pixels in the active area.

In an example, the plurality of first connection lines are located in the same layer as driving sources and driving drains of the plurality of sub-pixels in the active area.

In an example, each of the plurality of second connection lines has a part located in the same layer as driving sources and driving drains of the plurality of sub-pixels in the active area, and a part located in the same layer as driving gates of the plurality of sub-pixels in the active area.

In an example, the display substrate further includes an anisotropic conductive film covering the plurality of first array test pins and the plurality of second array test pins.

The present disclosure also provides a display panel including above display substrate.

BRIEF DESCRIPTION OF THE ACCOMPANYING DRAWINGS

DETAILED DESCRIPTION

Figure 1:
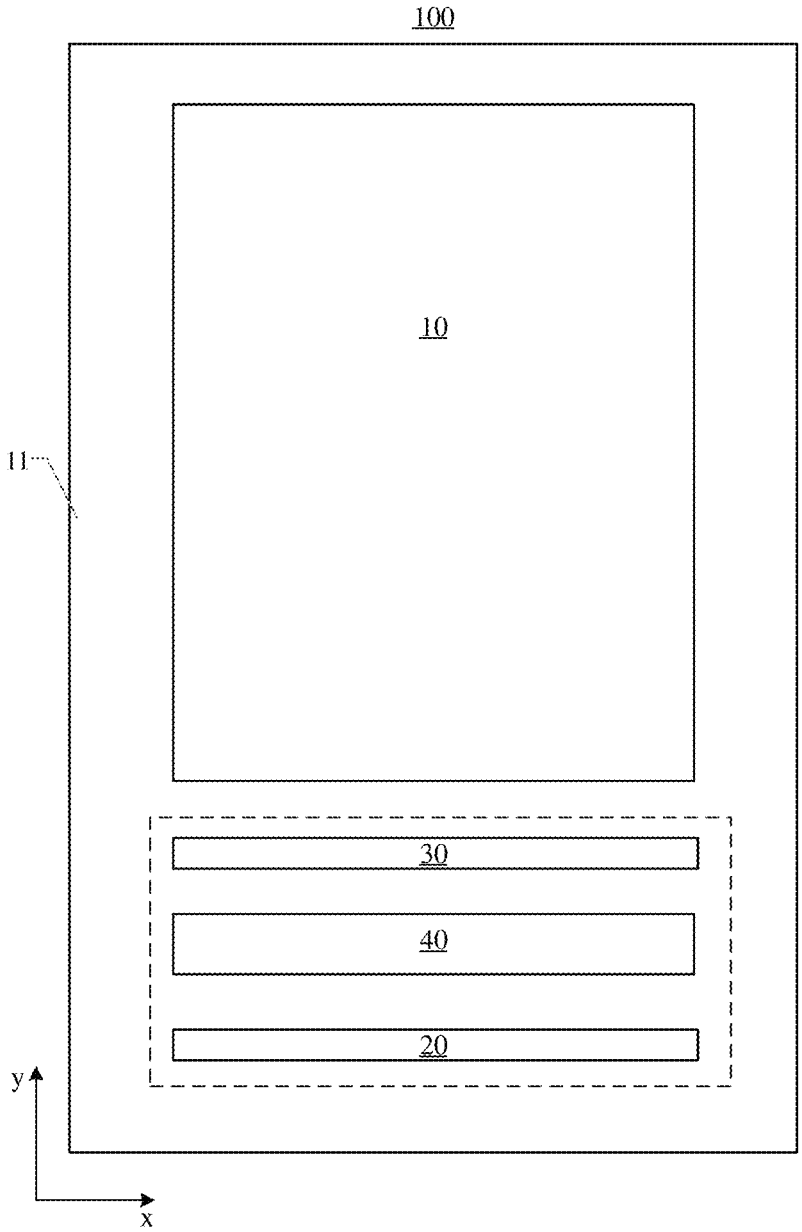
FIG. 1 shows a schematic diagram of a display substrate according to an embodiment of the present disclosure.

In order to make the objectives, technical solutions, and advantages of the embodiments of the present disclosure clearer, the technical solutions in the embodiments of the present disclosure will be described clearly and completely in the embodiments of the present disclosure in conjunction with the accompanying drawings. Obviously, the embodiments described are part of the embodiments of the present disclosure, but not all of them. Based on the described embodiments of the present disclosure, all other embodiments obtained by those of ordinary skill in the art without creative labor are within the protection scope of the present disclosure. It should be noted that throughout the drawings, the same elements are represented by the same or similar reference signs. In the following description, some specific embodiments are only used for descriptive purposes, and should not be construed as limiting the present disclosure, but are merely examples of the embodiments of the present disclosure. When it may cause confusion in the understanding of the present disclosure, conventional structures or configurations will be omitted. It should be noted that the shape and size of each component in the figure do not reflect the actual size and ratio, but merely illustrate the content of the embodiment of the present disclosure.

Unless otherwise defined, the technical or scientific terms used in the embodiments of the present disclosure should have usual meanings understood by those skilled in the art. The "first", "second" and similar words used in the embodiments of the present disclosure do not indicate any order, quantity, or importance, but are only used to distinguish different components.

In addition, in the description of the embodiments of the present disclosure, the term "coupled" or "coupled to" may mean that two components are directly coupled, or that two components are coupled via one or more other components. In addition, these two components can be coupled or coupled by wired or wireless means.

In a manufacturing process of a display panel, after a circuit structure of a display substrate is formed, and before a light-emitting layer is formed on the display substrate, an array test may be carried out to the circuit structure of the display substrate, to determine whether the circuit structure inside the display substrate is defective. In the related art, a plurality of array test pins coupled to the display panel are provided outside the display panel. The array test may be carried out to a pixel circuit inside the display panel through these array test pins. After the array test is completed, the array test pins are removed from the display panel, so as to form a display layer on the display substrate and to install a driving circuit. However, this brings inconvenience to the manufacture and test of the display panel.

In the embodiments of the present disclosure, the array test pins used for array testing are provided inside the display substrate. On one hand, the design of the array test pins does not constrained in the layout of the pins in the display substrate, which are used to connect the array test pins. On the other hand, additional steps for removing the array test pins are not required, which simplifies the manufacturing process and avoids the short circuit or leakage caused by removing the test pins.

FIG. 1 shows a schematic diagram of a display substrate according to an embodiment of the present disclosure.

As shown in FIG. 1, the display substrate 100 includes a base substrate, and the base substrate includes an active area 10 and a peripheral area 11 surrounding the active area 10.

A plurality of sub-pixels are provided in the active area 10, and the plurality of sub-pixels may be arranged in an array.

A first pin area 20 provided with a plurality of first pins and a second pin area 30 provided with a plurality of second pins are located in the peripheral area 11, and the second pin area 30 is located between the active area 10 and the first pin area 20.

A plurality of first array test pins and a plurality of second array test pins are provided in an area (indicated by 40 in FIG. 1) between the first pin area 20 and the second pin area 30. The plurality of first array test pins are used to provide array test signals, and the plurality of sub-pixels of the active area 10 may generate array test data signals in response to the array test signals. The plurality of second array test pins are used to receive array test data signals from the plurality of sub-pixels of the active area 10. The array test signals and the array test data signals may be used to realize an array test on the plurality of sub-pixels in the active area 10, to determine whether a pixel circuit in the active area 10 of the display substrate is abnormal, which will be described in further detail below.

The first array test pins and the second array test pins may be provided between the plurality of first pins 20 and the plurality of second pins 30 in various manners, which will be illustrated below with reference to FIGS. 2A to 2D.

FIGS. 2A to 2D show schematic diagrams of examples of a display substrate according to embodiments of the present disclosure.

Figure 2A:
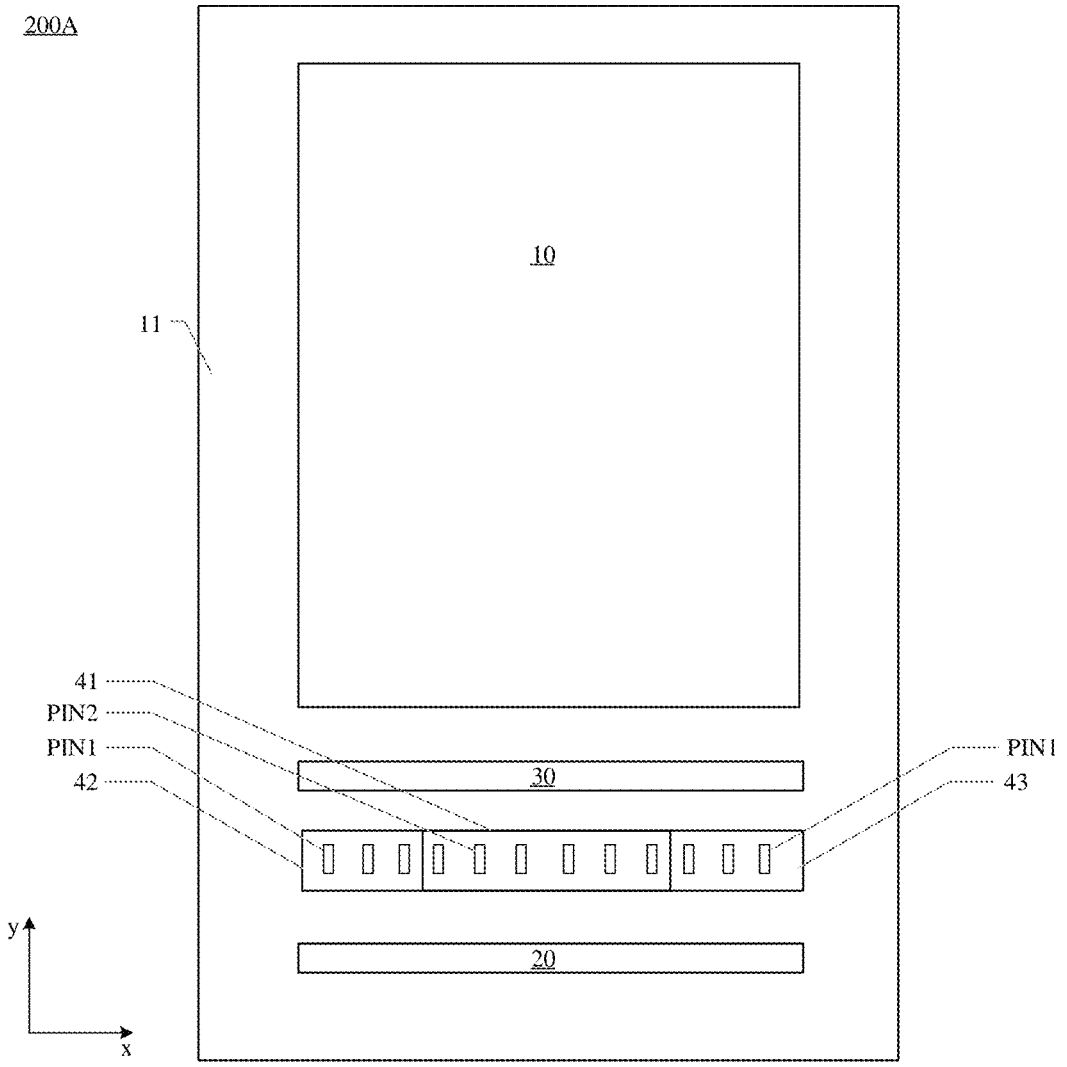
FIGS. 2A to 2D show schematic diagrams of examples of a display substrate according to an embodiment of the present disclosure.

As shown in FIG. 2A, the display substrate 200A includes an active area 10 and a peripheral area 11. The first pin area 20, the second pin area 30, and a plurality of first array test pins PIN1 and a plurality of second array test pins PIN2 provided between the first pin area 20 and the second pin area 30 are located in the peripheral area 11.

The plurality of second array test pins PIN2 are provided in a first area 41. A part of the plurality of first array test pins PIN1 (for example, the three first array test pins PIN1 on the left in FIG. 2A) are provided in a second area 42, and the other part of the plurality of first array pins PIN1 (the three first array test pins PIN1 on the right in FIG. 2A) are provided in a third area 43. The first area 41, the second area 42 and the third area 43 are all located between the first pin area 20 and the second pin area 30. The first pin area 20 and the second pin area 30 are arranged in a first direction (y direction in FIG. 2A) on a side of the active area 10. The first area 41, the second area 42, and the third area 43 are arranged in a second direction (x direction in FIG. 2A) perpendicular to the first direction. The second area 42 and the third area 43 are located respectively on both sides of the first area 41. In FIG. 2A, the second area 42 is located on the left side of the first area 41, and the third area 43 is located on the right side of the first area 41. In FIG. 2A, the plurality of first array test pins PIN1 and the plurality of second array test pins PIN2 are arranged in a row in the x direction. By providing the second area 42 and the third area 43 on both sides of the first area 41, distribution of the first array test pins PIN1 and the second array test pins PIN2 may have higher symmetry. In some embodiments, the number of pins in the second area 42 may be equal to the number of pins in the third area 43, thereby improving the symmetry further.

However, the embodiments of the present disclosure are not limited thereto, and the first array test pins PIN1 and the second array test pins PIN2 may be provided between the first pin area 20 and the second pin area 30 in other ways.

Figure 2B:
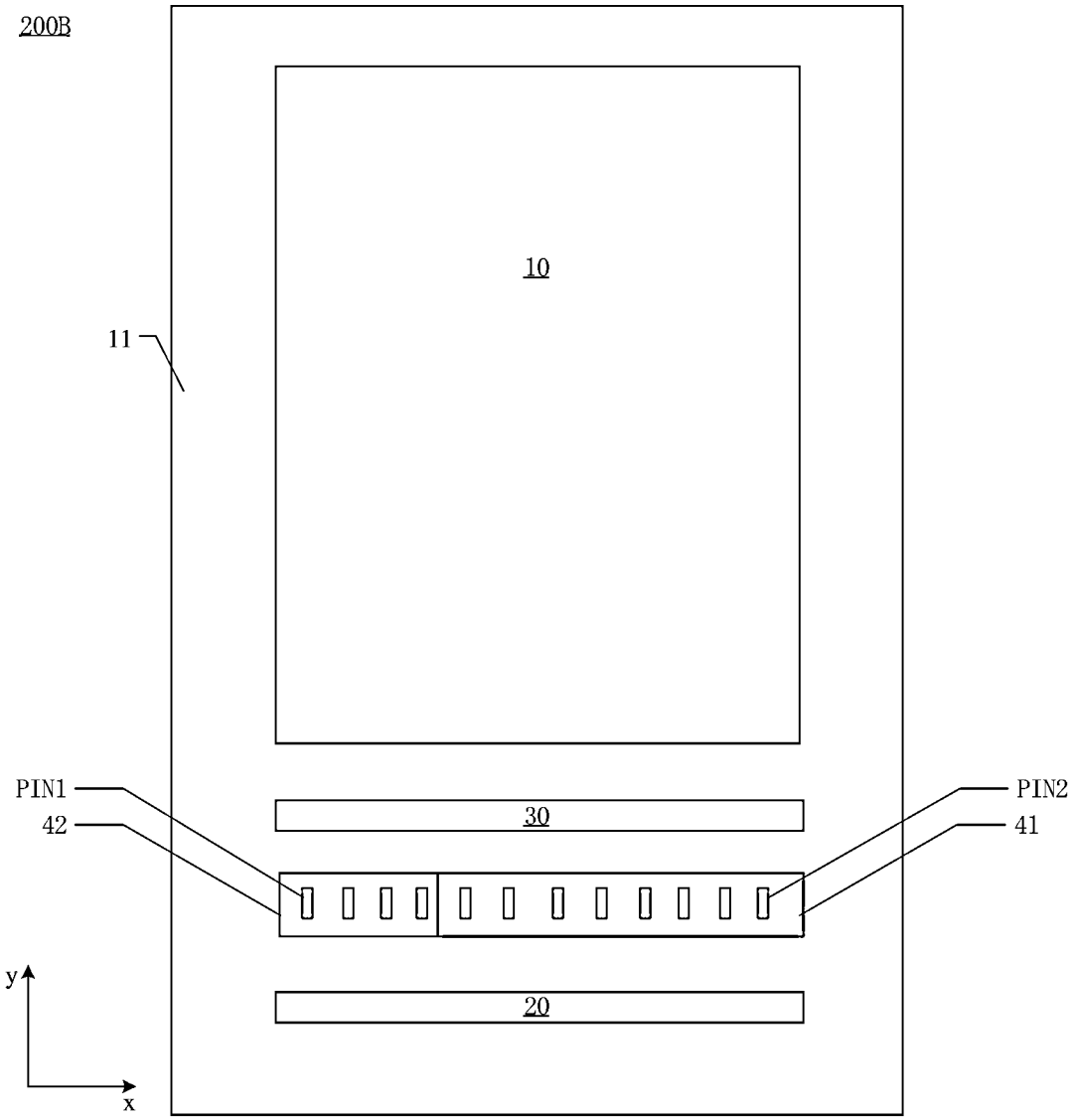

In some embodiments, as shown in FIG. 2B, the first array test pins PIN1 and the second array test pins PIN2 may be provided respectively in two areas. In FIG. 2B, the second array test pins PIN2 are provided in the first area 41, and the first array test pins PIN1 are provided in the second area 42. Both the first area 41 and the second area 42 are located between the first pin area 20 and the second pin area 30. In FIG. 2B, the first area 41 and the second area 42 are arranged in the x direction, so that the first array test pins PIN1 and the second array test pins PIN2 are arranged in a row in the x direction. The first area 41 and the second area 42 may also be arranged in other ways, for example, arranged in the y direction or arbitrarily arranged. In some embodiments, the first array test pins PIN1 and the second array test pins PIN2 may be distributed in four or more areas.

Figure 2C:
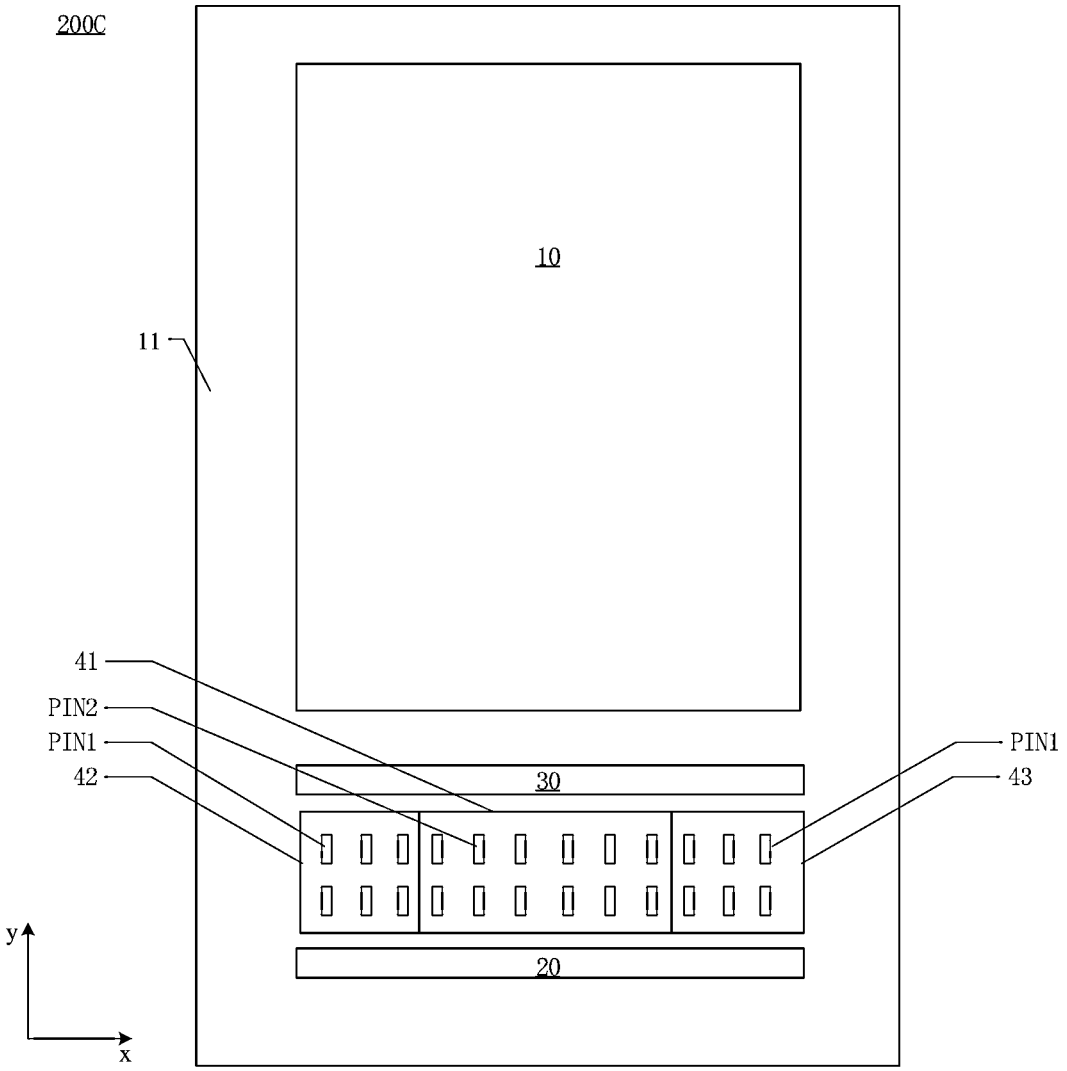

In some embodiments, as shown in FIG. 2C, the first array test pins PIN1 and the second array test pins PIN2 may be arranged in multiple rows. In FIG. 2C, the plurality of second array test pins PIN2 are provided in the first area 41. A part of the plurality of first array test pins PIN1 (for example, the six first array test pins PIN1 on the left in FIG. 2C) are provided in the second area 42, and the other part of the plurality of first array test pins PIN1 (the six first array test pins PIN1 on the right in FIG. 2C) are provided in the third area 43. The first area 41, the second area 42, and the third area 43 are provided between the first pin area 20 and the second pin area 30 in a manner similar to that shown in FIG. 2A. The second array test pins PIN2 in the first area 41 and the first array test pins PIN2 in the second area 42 and the third area 43 are all arranged in two rows in the x direction, so that the first array test pins PIN1 and the second array test pins PIN2 are also arranged as a whole in two rows in the x direction. However, the embodiments of the present disclosure are not limited thereto, and the first array test pins PIN1 and the second array test pins PIN2 may be also arranged in three rows or more. In this way, a size of the space occupied by the first array test pins and the second array test pins (hereinafter collectively referred to as the array test pins) in the x direction may be reduced, or more array test pins may be provided in a case where the size of the space in the x direction on the display substrate is limited.

Figure 2D:
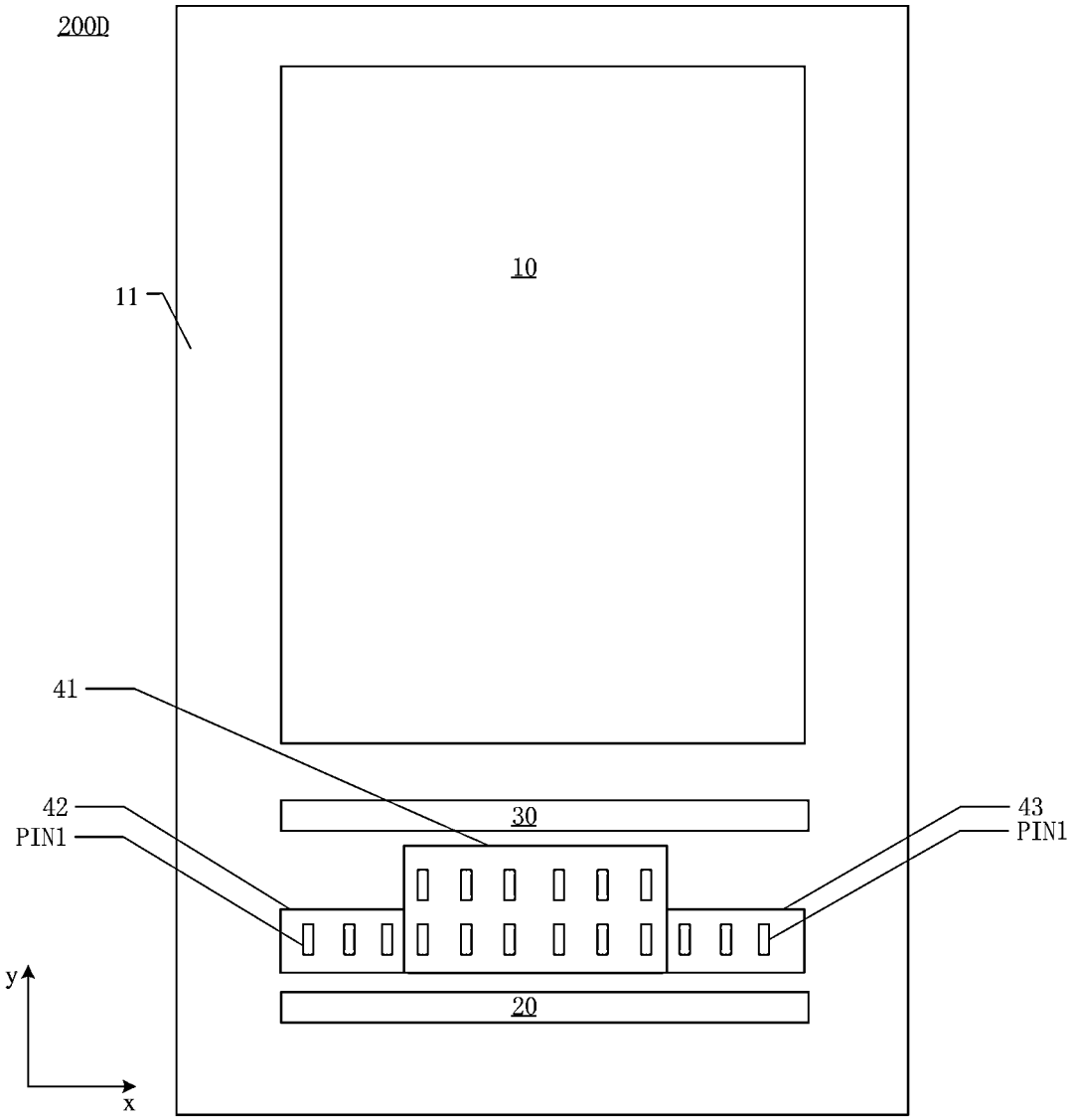

In some embodiments, as shown in FIG. 2D, the first array test pins PIN1 and the second array test pins PIN2 may be partially arranged in a row and partially arranged in multiple rows. In FIG. 2D, a plurality of second array test pins PIN2 are provided in the first area 41, and a part of the plurality of first array test pins PIN1 (for example, the three first array test pins PIN1 on the left in FIG. 2D) are provided in the second area 42, and the other part of the plurality of first array test pins PIN1 (the three first array test pins PIN1 on the right in FIG. 2D) are provided in the third area 43. The plurality of second array test pins PIN2 in the first area 41 are arranged in two rows in the x direction, and in FIG. 2D, they are arranged in a 2×6 array. Each of the first array test pins PIN1 in the second area 42 and the first array test pins PIN1 in the third area 43 is arranged in a row, and in FIG. 2D, each of them is arranged in a 1×3 array.

Although a layout of the first array test pins and the second array test pins in the embodiment of the present disclosure has been described above through specific examples, the embodiments of the present disclosure are not limited thereto. The first array test pins and the second array test pins may be provided between the first pin area 20 and the second pin area 30 in any other manner as required.

Figure 3A:
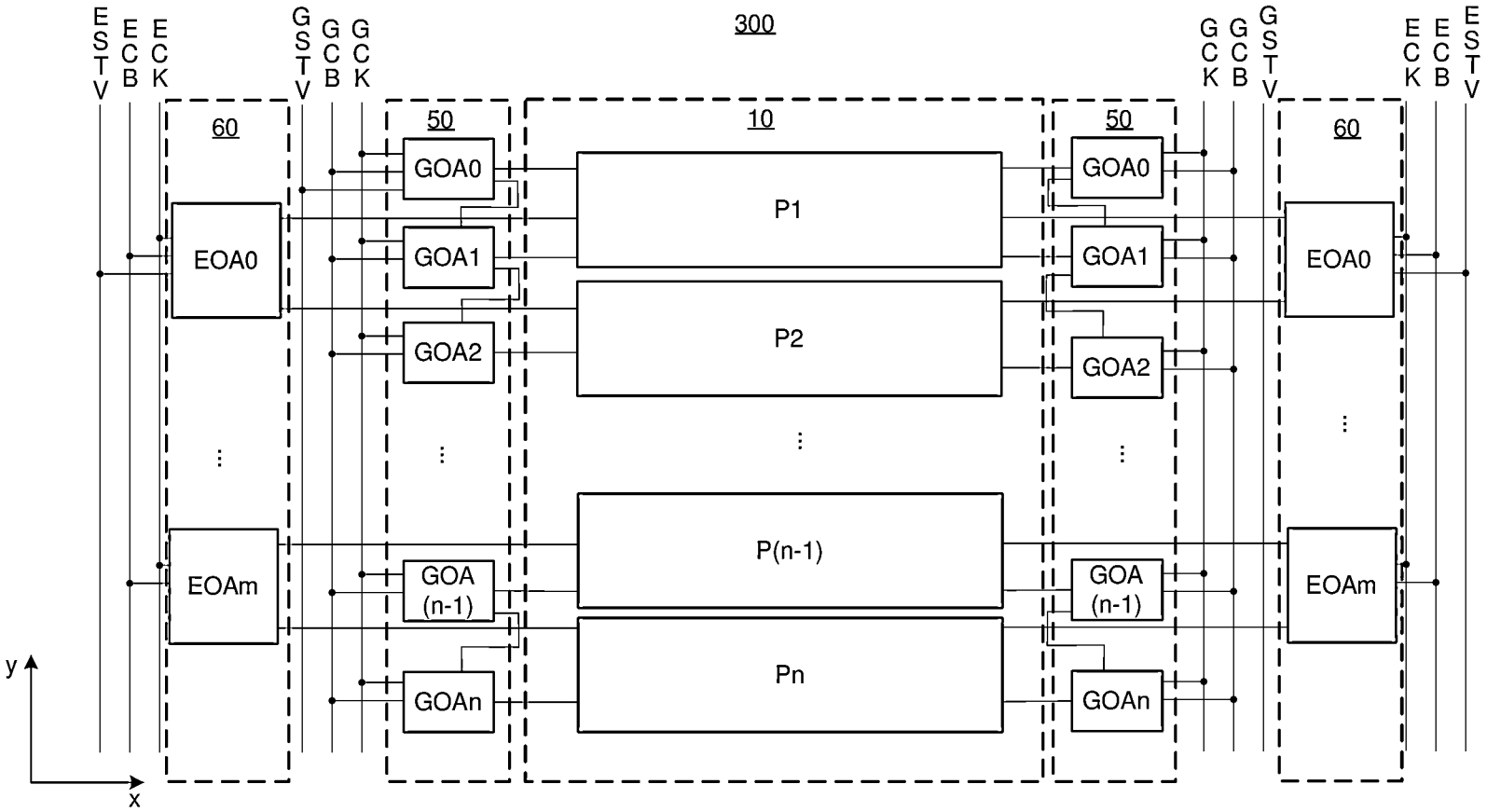
FIG. 3A shows a schematic diagram of a partial structure of a display substrate according to an embodiment of the present disclosure, in which the structure of a driving circuit is shown.
Figure 3B:
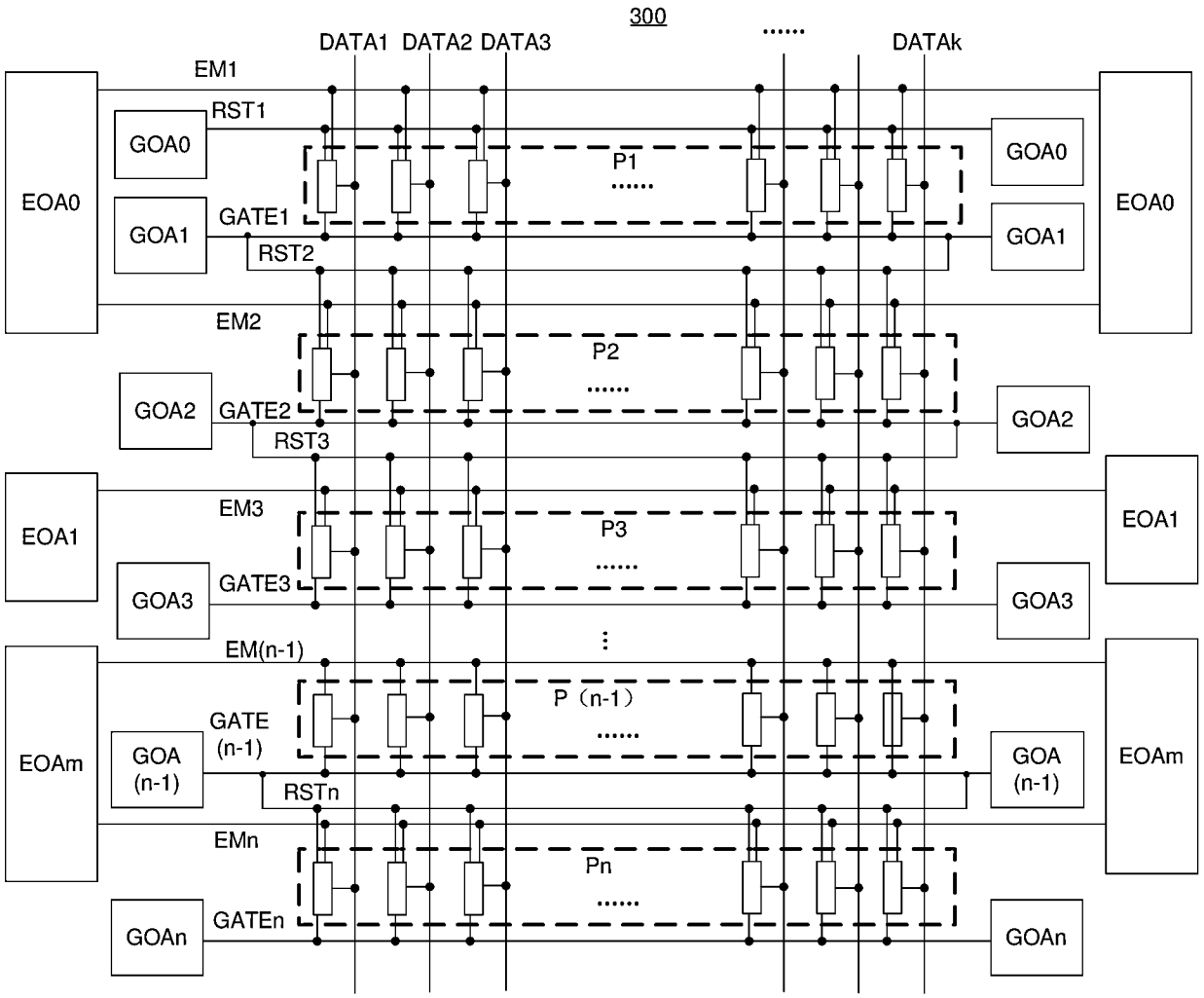
FIG. 3B shows a schematic diagram of a partial structure of a display substrate according to an embodiment of the present disclosure, in which the structures of a driving circuit and an active area are shown.

A driving circuit of the display substrate in the embodiment of the present disclosure will be described below with reference to FIGS. 3A and 3B. FIG. 3A shows a schematic diagram of a partial structure of a display substrate 300 according to an embodiment of the present disclosure, in which a driving circuit and a structure are shown. FIG. 3B shows a schematic diagram of a partial structure of a display substrate 300 according to an embodiment of the present disclosure, in which a structure of the driving circuit and a structure of the active area are shown.

As shown in FIGS. 3A and 3B, a plurality of sub-pixels P are provided in the active area 10 of the display substrate 300, and the plurality of sub-pixels P may be arranged in an array, for example, arranged in the form of multiple rows, including a $1^{st}$ row of sub-pixels P1, a $2^{nd}$ row of sub-pixels P2, . . . , an $n^{th}$ row of sub-pixels Pn.

A plurality of data lines DATA1, DATA2, . . . , DATAk are located in the active area and extend in a first direction (y direction), and the plurality of data lines DATA1, DATA2, . . . , DATAk are electrically coupled to the plurality of sub-pixels P. For example, in FIG. 3B, data line DATA1 is coupled to a $1^{st}$ column of sub-pixels P, data line DATA2 is coupled to a $2^{nd}$ column of sub-pixels P, and so on, data line DATAk is coupled to a $k^{th}$ column of sub-pixels.

A plurality of gate lines GATE1, GATE2, . . . , GATEn are located in the active area 10 and extend in a second direction (x direction). The first direction (y direction) and the second direction (x direction) intersect. The plurality of gate lines GATE1, GATE2, . . . , GATEn are electrically coupled to the plurality of sub-pixels P. For example, gate line GATE1 is coupled to the $1^{st}$ row of sub-pixels P1, gate line GATE2 is coupled to the $2^{nd}$ row of sub-pixels P2, and so on, gate line GATEn is coupled to the $n^{th}$ row of sub-pixels Pn.

The gate driving circuit 50 is located in the peripheral area 11 and coupled to the plurality of gate lines GATE1, GATE2, . . . , GATEn. For example, in FIG. 3B, the gate driving circuit 50 includes a plurality of shift registers GOA0, GOA1, . . . , GOAn that are cascaded in multiple stages, that is, an output terminal of a first shift register GOAi of an $i^{th}$ stage is coupled to a reset terminal of a first shift register GOA(i+1) of an $(i+1)^{th}$ stage. A first shift register GOA1 of a $1^{st}$ stage is coupled to gate line GATA1 to provide a gate driving signal to the $1^{st}$ row of sub-pixels P1, and a first shift register GOA2 of a $2^{nd}$ stage is coupled to gate line GATA2 to provide a gate driving signal to the $2^{nd}$ row of sub-pixels P2, and so on. In FIG. 3B, a gate driving signal for an $i^{th}$ row of sub-pixels P1 generated by a shift register GOAi of the $i^{th}$ stage is also used as a reset signal RST(i+1) for an $(i+1)^{th}$ row of sub-pixels P(i+1). For example, a gate driving signal for a $0^{th}$ row of sub-pixels P0 generated by a first shift register GOA0 of a $0^{th}$ stage is also used as a reset signal RST1 for a $1^{th}$ row of sub-pixels P1, and a gate driving signal for the $1^{st}$ row of sub-pixels P1 generated by a first shift register GOA1 of the $1^{st}$ stage is also used as a reset signal RST2 for a $2^{nd}$ row of sub-pixels P2, and so on.

As shown in FIG. 3A, the gate driving circuit 50 is also electrically coupled to a first start-up voltage signal line GSTV, a first clock signal line GCK, and a second clock signal line GCB, so as to generate a gate driving signal under their control. For example, the first shift register GOA0 of the $0^{th}$ stage in the gate driving circuit 50 is electrically coupled to the first start-up voltage signal line GSTV, the first clock signal line GCK, and the second clock signal line GCB, so as to generate a gate driving signal for the $0^{th}$ row of sub-pixels under the control of the first start-up voltage signal line GSTV, the first clock signal line GCK, and the second clock signal line GCB, which is also used as the reset signal RST1 in FIG. 3B. Similarly, the first shift register GOA1 of the $1^{st}$ stage in the gate driving circuit 50 is electrically coupled to the first clock signal line GCK and the second clock signal line GCB, so as to generate a gate driving signal for the $1^{st}$ row of sub-pixels under the control of the first clock signal line GCK and the second clock signal line GCB, which is also used as the reset signal RST2 in FIG. 3B.

As shown in FIGS. 3A and 3B, the display substrate may also include a plurality of light-emitting control lines EM1, EM2, . . . , EMn and a light-emitting control driving circuit 60. A plurality of light-emitting control lines EM1, EM2, . . . , EMn pass through the active area 10 and extend in a second direction (x direction). The plurality of light-emitting control lines EM1, EM2, . . . , EMn are electrically coupled to the plurality of sub-pixels P. For example, in FIG. 3B, the light-emitting control line EM1 is electrically coupled to the $1^{st}$ row of sub-pixels P1, the light-emitting control line EM2 is electrically coupled to the $2^{nd}$ row of sub-pixels P2, and so on.

The light-emitting control driving circuit 60 is located in the peripheral area 11 and located on a side of the gate driving circuit 50 away from the active area 10. In FIGS. 3A and 3B, the light-emitting control driving circuit 60 includes multiple stages of cascaded second shift registers EOA0, EOA1, . . . , EOAm. The second shift register EOA0 of the $0^{th}$ stage is coupled to the light-emitting control lines EM1 and EM2, to provide light-emitting control signals to the $P^t$ row of sub-pixels P1 and the $2^{nd}$ row of sub-pixels P2 respectively. The second shift register EOA1 of the $1^{st}$ stage is coupled to the light-emitting control lines EM3 and EM4, to provide light-emitting control signals to the $3^{rd}$ row of sub-pixels P3 and P4 respectively. In the examples of FIGS. 3A and 3B, since each of the second shift registers provides light-emitting control signals to two rows of sub-pixels, the number of second shift registers may be half of the number of first shift registers. The embodiments of the present disclosure are not limited thereto, and the number and a cascade manner of the first shift register and the second shift register may be set as required.

A second start-up voltage signal line ESTV, a third clock signal line ECK, and a fourth clock signal line ECB may also be provided in the peripheral area 11. The light-emitting control driving circuit 60 is also electrically coupled to the second start-up voltage signal line ESTV, the third clock signal line ECK, and the fourth clock signal line ECB, so as to generate a light-emitting control signal under their control. For example, in the light-emitting control driving circuit 60, the second shift register EOA0 of the $0^{th}$ stage is electrically coupled to the second start-up voltage signal line ESTV, the third clock signal line ECK, and the fourth clock signal line ECB, so as to generate light-emitting control signals for the $1^{st}$ row of sub-pixels P1 and the $2^{nd}$ row of sub-pixels P2 under the control of the second start-up voltage signal line ESTV, the third clock signal line ECK, and the fourth clock signal line ECB. Similarly, in the light-emitting control driving circuit 60, the second shift register EOA1 of the $P^t$ stage is electrically coupled to the third clock signal line ECK, and the fourth clock signal line ECB, so as to generate light-emitting control signals for the $2^{nd}$ row of sub-pixels P2 and the $3^{rd}$ row of sub-pixels P3 under the control of the third clock signal line ECK, and the fourth clock signal line ECB.

Figure 4A:
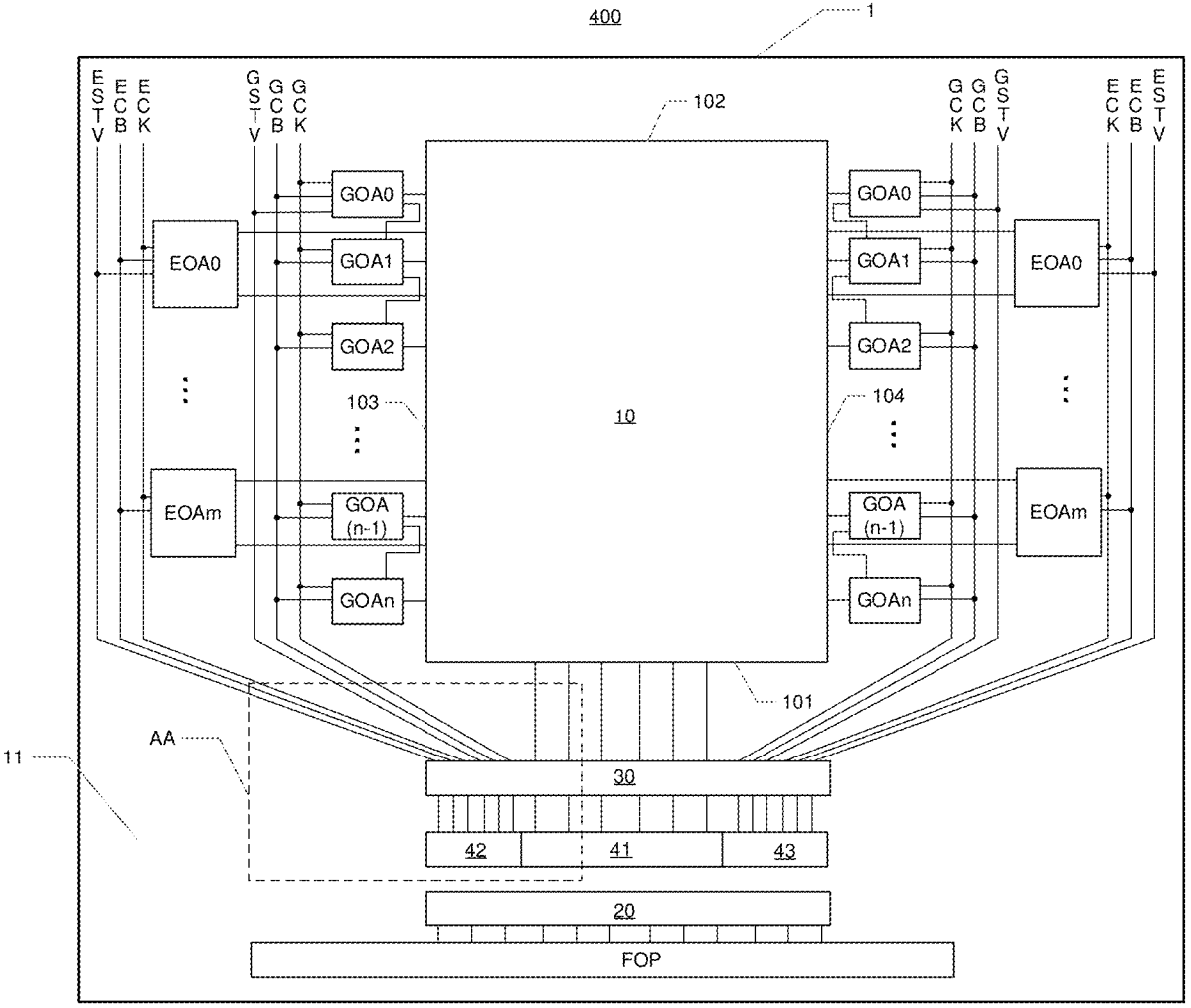
FIG. 4A shows a structural diagram of a display substrate according to an embodiment of the present disclosure.
Figure 4B:
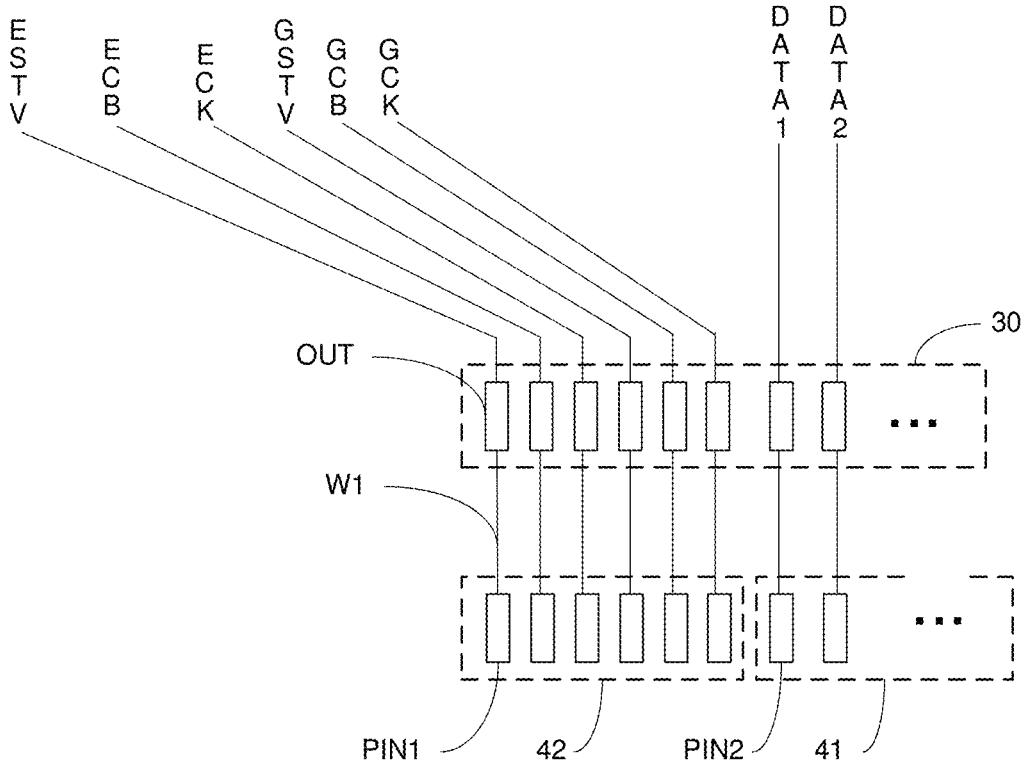
FIG. 4B shows a partial enlarged view of FIG. 4A.

FIG. 4A shows a structural diagram of a display substrate according to an embodiment of the present disclosure. FIG. 4B shows an enlarged view of an area indicated by a dashed frame AA in FIG. 4A.

As shown in FIG. 4A, the display substrate 400 includes a base substrate 1, and the base substrate 1 includes an active area 10 and a peripheral area 11 surrounding the active area 10.

A plurality of sub-pixels, a plurality of data lines, and a plurality of gate lines may be provided in the active area 10 in the manner described above with reference to FIGS. 3A and 3B.

A gate driving circuit and a plurality of gate lines may be provided in the peripheral area 11, for example, the gate driving circuit 50 and a plurality of gate lines GATE1, GATE2, . . . , GATEn as described above with reference to FIGS. 3A and 3B. Herein, the gate driving circuit 50 includes a plurality of first shift registers GOA0, GOA1, . . . , GOAn that are cascaded in multiple stages. In the peripheral region 11, the first start-up voltage signal line GSTV, the first clock signal line GCK, and the second clock signal line GCB coupled to the gate driving circuit may also be provided in the manner as described above with reference to FIGS. 3A and 3B.

A plurality of first pins and a plurality of second pins may be provided in the peripheral area 11, and the plurality of second pins are located between the active area 10 and the plurality of first pins. For example, the plurality of first pins may be provided in the first pin area 20 as described above with reference to FIGS. 2A to 2D, and the plurality of second pins may be provided in the second pin area 30 as described above with reference to FIGS. 2A to 2D.

A plurality of first array test pins PIN1 and a plurality of second array test pins PIN2 may also be provided in the peripheral area 11. The plurality of first array test pins PIN1 and the plurality of second array test pins PIN2 are located between the area 20 where the plurality of first pins are located and the area 30 where the plurality of second pins are located. The plurality of second array test pins PIN2 extend in a direction of a boundary of the active area 10, and the plurality of first array test pins PIN1 are located on at least one side of the plurality of second array test pins PIN2 in an extension direction of the boundary of the active area 10.

The plurality of first array test pins PIN1 are respectively electrically coupled to a plurality of array test signal lines, and the plurality of array test signal lines include at least one of the first start-up voltage signal line GSTV, the first clock signal line GCK, and the second clock signal line GCB. For example, in FIG. 4A, the plurality of array test signal lines may include the first start-up voltage signal line GSTV, the first clock signal line GCK, and the second clock signal line GCB, which are respectively coupled to the plurality of first array test pins PIN1.

The plurality of second array test pins PIN2 are respectively electrically coupled to the plurality of data lines DATA1, DATA2, . . . , DATAk, and the plurality of second array test pins PIN2 may receive array test data signals from the plurality of sub-pixels in the active area 10 through the plurality of data lines DATA1, DATA2, . . . , DATAk.

The active area 10 includes a first boundary 101, a second boundary 102, a third boundary 103, and a fourth boundary 104 (for example, a lower boundary, an upper boundary, a left boundary, and a right boundary) coupled in sequence, and the plurality of first array test pins PIN1 and the plurality of second array test pins PIN2 are located in the peripheral area 11 close to the first boundary (the lower boundary).

In FIG. 4A, the gate driving circuit may include a first sub-circuit and a second sub-circuit, and the first sub-circuit and the second sub-circuit are located respectively in the peripheral area 11 close to the second boundary (the left boundary) and the fourth boundary (the right boundary). For example, in FIG. 4A, the first sub-circuit includes a group of first shift registers GOA0, GOA1, . . . , GOAn located on the left side of the active area 10, and the second sub-circuit includes another group of first shift registers GOA0, GOA1, . . . , GOAn located on the right side of the active area 10.

Each of the first start-up voltage signal line GSTV, the first clock signal line GCK, and the second clock signal line GCB may also be divided into two parts, which are respectively provided on both sides of the active area 10. For example, as shown in FIG. 4A, the first start-up voltage signal line GSTV includes a first sub-line of first start-up voltage signal line and a second sub-line of first start-up voltage signal line that are located respectively on the left and right sides of the active area 10. The first clock signal line GCK includes a first sub-line of first clock signal line and a second sub-line of first clock signal line that are located respectively on the left and right sides of the active area 10. The second clock signal line GCB includes a first sub-line of second clock signal line and a second sub-line of second clock signal line that are located respectively on the left and right sides of the active area 10. The first sub-line of first start-up voltage signal line, the first sub-line of first clock signal line, and the first sub-line of second clock signal line located on the left side of the active area 10 are electrically coupled to the first sub-circuit, and the second sub-line of first start-up voltage signal line, the second sub-line of first clock signal line, and the second sub-line of second clock signal line located on the right side of the active area 10 are electrically coupled to the second sub-circuit.

The plurality of first array test pins PIN1 may include a first group of first array test pins and a second group of first array test pins, and the first group of first array test pins and the second group of first array test pins are located respectively on both sides of the plurality of second array test pins PIN2 in an extension direction along the first boundary. For example, in FIG. 4A, the plurality of first array test pins PIN1 and the plurality of second array test pins PIN2 are provided in a manner as described above with reference to FIG. 2A. The plurality of second array test pins PIN2 are provided in the first area 41, the plurality of first array test pins PIN1 are provided in the second area 42 and the third area 43 that are located respectively on both sides of the first area 41.

As shown in FIGS. 4A and 4B, the first sub-line of first start-up voltage signal line (indicated by GSTV in FIG. 4B), the first sub-line of first clock signal line (indicated by GCK in FIG. 4B), and the first sub-line of second clock signal line (indicated by GCB in FIG. 4B) that are located on the left side of the active area 10 are electrically coupled to the first group of first array test pins PIN1 in the second area 42. In a similar manner, the second sub-line of first start-up voltage signal line, the second sub-line of first clock signal line, and the second sub-line of second clock signal line that are located on the right side of the active area 10 are electrically coupled to the second group of first array test pin PIN1 in the third area 43, which will not be repeated here.

In some embodiments, a light-emitting control driving circuit and a plurality of light-emitting control lines may also be provided in the peripheral area 11 of the display substrate 400, for example, the light-emitting control driving circuit 60 and the light-emitting control lines EM1, EM2, . . . , EMn as described above with reference to FIGS. 3A and 3B. The light-emitting control driving circuit 60 includes a plurality of second shift registers EOA0, EOA1, . . . , EOAm that are cascaded in multiple stages. In the peripheral area 11, the second start-up voltage signal line ESTV, the third clock signal line ECK, and the fourth clock signal line ECB coupled to the light-emitting control driving circuit may also be provided in the manner described above with reference to FIGS. 3A and 3B. The light-emitting control driving circuit may be electrically coupled to the second start-up voltage signal line ESTV, the third clock signal line ECK, and the fourth clock signal line ECB in the manner described above with reference to FIGS. 3A and 3B. The plurality of array test signal lines may include at least one of the second start-up voltage signal line ESTV, the third clock signal line ECK, and the second clock signal line ECB, in addition to at least one of the first start-up voltage signal line GSTV, the first clock signal line GCK and the second clock signal line GCB. In FIG. 4B, the first start-up voltage signal line GSTV, the first clock signal line GCK, the second clock signal line GCB, the second start-up voltage signal line ESTV, the third clock signal line ECK and the fourth clock signal line ECB are respectively coupled in one-to-one correspondence with six first array test pins PIN.

Similar to the gate driving circuit, the light-emitting control driving circuit may also include a third sub-circuit and a fourth sub-circuit located respectively on both sides of the active area 10. For example, the third sub-circuit and the fourth sub-circuit may be located respectively in the peripheral area 11 close to the second boundary (the left boundary) and the fourth boundary (the right boundary) of the active area 10. In FIG. 4A, the first sub-circuit of the light-emitting control driving circuit includes a group of second shift registers EOA0, EOA1, . . . , EOAm located on the left side of the active area 10, and the second sub-circuit includes another group of second shift registers EOA0, EOA1, . . . , EOAm located on the right side of the active area 10.

Each of the second start-up voltage signal line ESTV, the third clock signal line ECK, and the fourth clock signal line ECB may also be divided into two parts, which are respectively provided on both sides of the active area 10. For example, as shown in FIG. 4A, the second start-up voltage signal line ESTV includes a first sub-line of second start-up voltage signal line and a second sub-line of second start-up voltage signal line that are located respectively on the left and right sides of the active area 10. The third clock signal line ECK includes a first sub-line of third clock signal line and a second sub-line of third clock signal line that are located respectively on the left and right sides of the active area 10. The fourth clock signal line ECB includes a first sub-line of fourth clock signal line and a second sub-line of fourth clock signal line that are located respectively on the left and right sides of the active area 10. The first sub-line of second start-up voltage signal line, the first sub-line of third clock signal line, and the first sub-line of fourth clock signal line located on the left side of the active area 10 are electrically coupled to the first sub-circuit of the light-emitting control driving circuit, and the second sub-line of second start-up voltage signal line, the second sub-line of third clock signal line, and the second sub-line of fourth clock signal line located on the right side of the active area 10 are electrically coupled to the second sub-circuit of the light-emitting control driving circuit.

As shown in FIGS. 4A and 4B, the first sub-line of second start-up voltage signal line (indicated by ESTV in FIG. 4B), the first sub-line of third clock signal line (indicated by ECK in FIG. 4B), and the first sub-line of fourth clock signal line (indicated by ECB in FIG. 4B) that are located on the left side of the active area 10) are electrically coupled to the first group of first array test pins PIN1 in the second area 42. In a similar manner, the second sub-line of second start-up voltage signal line, the second sub-line of third clock signal line, and the second sub-line of fourth clock signal line that are located on the right side of the active area 10 are electrically coupled to the second group of first array test pins PIN1 in the third area 43, which will not be repeated here.

In some embodiments, at least a part of the plurality of array test signal lines may be coupled in one-to-one correspondence with a part of the plurality of second pins, and the part of the plurality of second pins are coupled in one-to-one correspondence with at least a part of the plurality of first array test pins through a plurality of first connection lines. As shown in FIG. 4B, the plurality of array test signal lines include the first start-up voltage signal line GSTV, the first clock signal line GCK, the second clock signal line GCB, the second start-up voltage signal line ESTV, the third clock signal line ECK and the fourth clock signal lines ECB are respectively coupled in one-to-one correspondence with six second pins OUT, and the six second pins OUT are respectively coupled in one-to-one correspondence with six first array test pins PIN through six first connection lines W1.

In some embodiments, a plurality of connection pins (indicated by FOP in FIG. 4A) may also be provided in the peripheral area 11 of the display substrate 400, and the plurality of first pins located in the first pin area 20 may be electrically coupled to the plurality of connection pins FOP, so as to be coupled to a flexible circuit board.

Figure 5A:
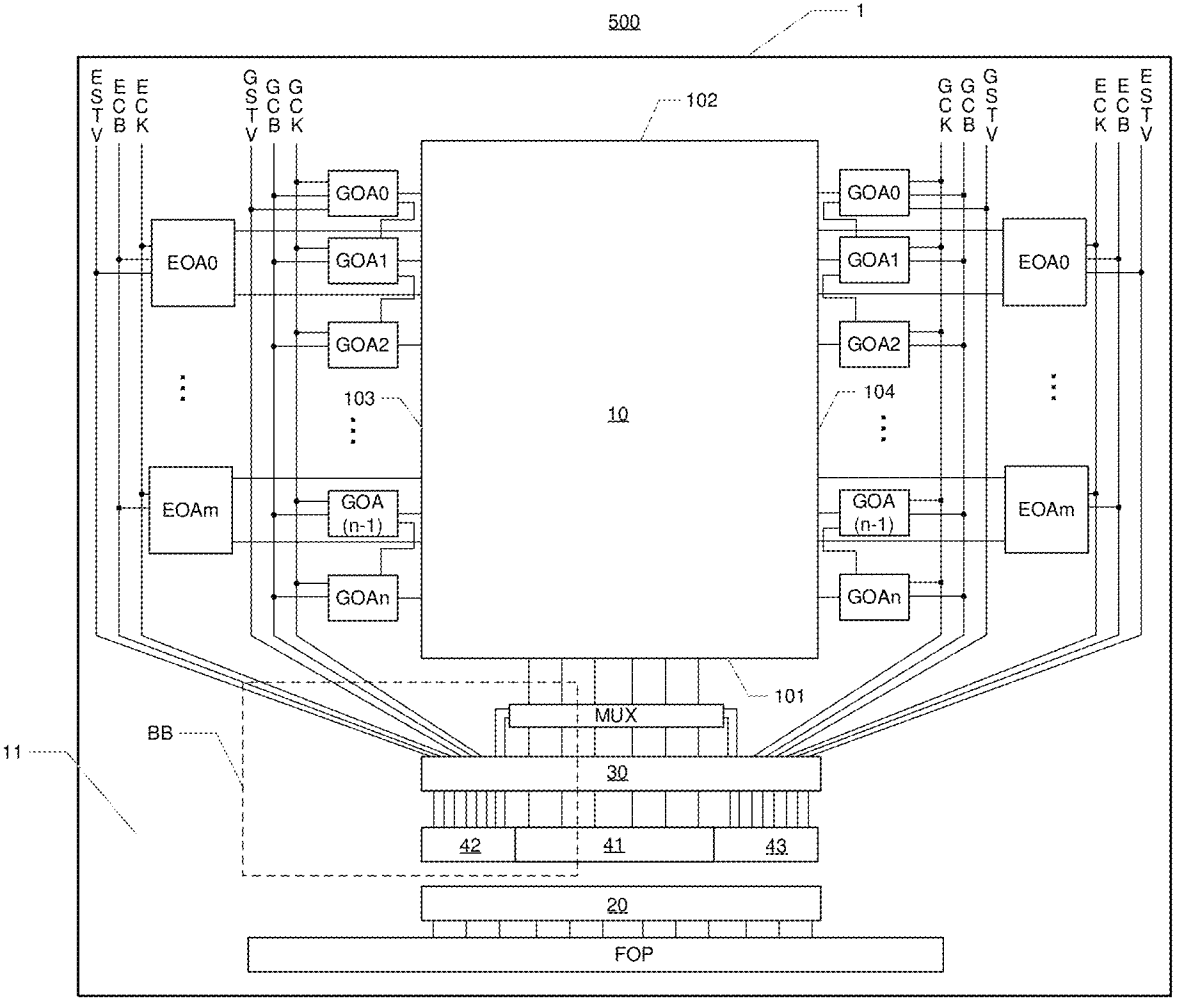
FIG. 5A shows a structural diagram of a display substrate according to another embodiment of the present disclosure.
Figure 5B:
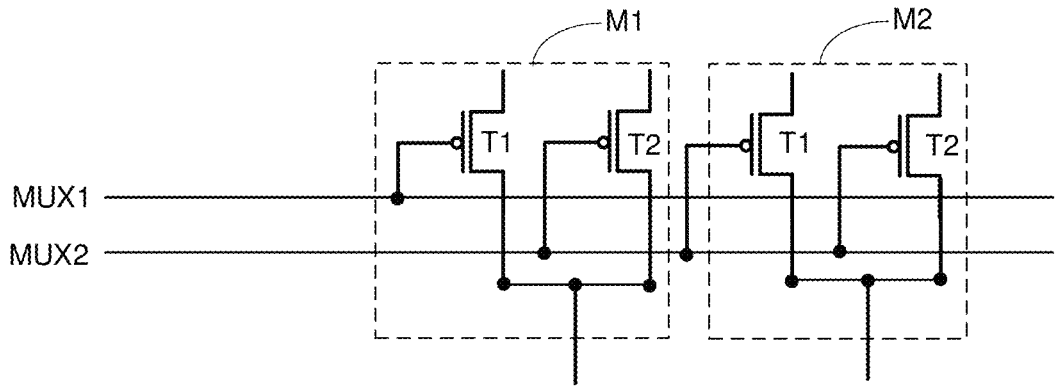
FIG. 5B shows a circuit diagram of a multiplex circuit in a display substrate according to an embodiment of the present disclosure.
Figure 5C:
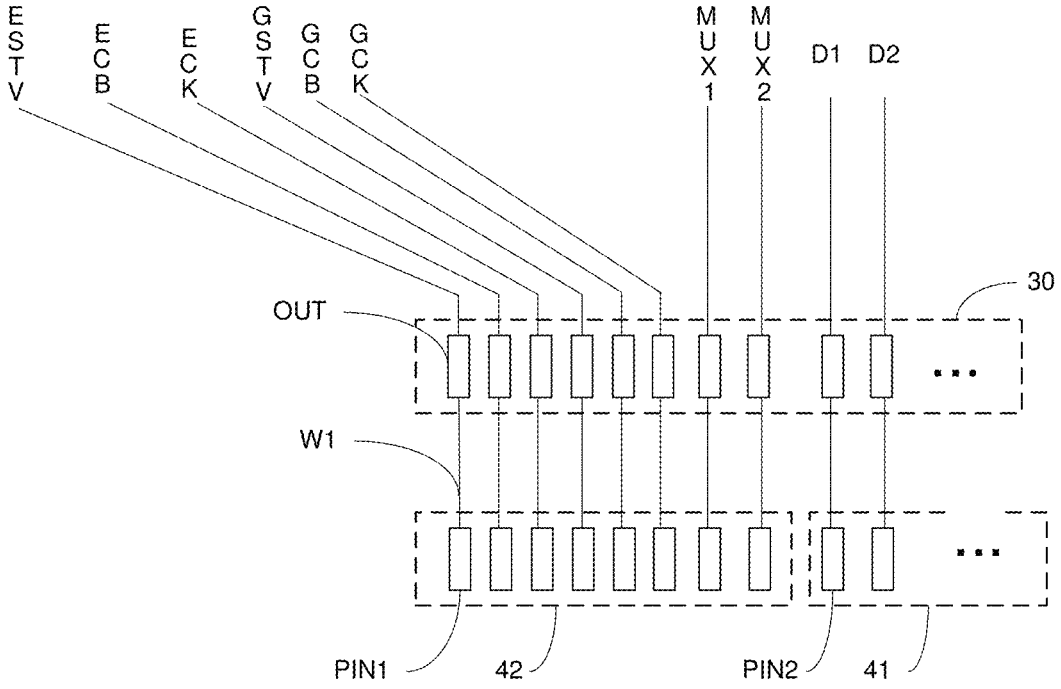
FIG. 5C shows a partial enlarged view of FIG. 5A.

FIG. 5A shows a structural diagram of a display substrate according to another embodiment of the present disclosure. FIG. 5B shows a circuit diagram of a multiplex circuit in a display substrate according to an embodiment of the present disclosure. FIG. 5C shows an enlarged view of an area indicated by a dashed frame BB in FIG. 5A. The display substrate 500 in FIGS. 5A to 5C is similar to the display substrate 400 in FIGS. 4A to 4B, and difference thereof lies at least in that the display substrate 500 further includes a multiplex circuit MUX. For the sake of brevity, the difference is mainly described below in detail.

As shown in FIGS. 5A to 5C, a multiplex circuit MUX and a first selection signal line MUX1 and a second selection signal line MUX2 are also provided in the peripheral area 11 of the display substrate 500.

The multiplex circuit MUX is located between the plurality of second pins (the second pin area 30) and the active area 11. As shown in FIG. 5B, the multiplex circuit MUX includes a plurality of multiplex switches M1, M2, . . . , and at least one of the plurality of multiplex switches M1, M2, . . . includes a first transistor T1 and a second transistor T2. A gate of the first transistor T1 is electrically coupled to the first selection signal line MUX1, and a gate of the second transistor T2 is electrically coupled to the second selection signal line MUX2. First electrodes of the first transistor T1 and the second transistor T2 are coupled to a second pin. Second electrodes of the first transistor T1 and the second transistor T2 are respectively coupled to two data signal lines.

In the display substrate 500, as compared to the display substrate 400, the plurality of array test signal lines may further include the first selection signal line MUX1 and the second selection signal line MUX2. As shown in FIG. 5B, among the plurality of first array test pins PIN1, in addition to those respectively electrically coupled to the first start-up voltage signal line GSTV, the first clock signal line GCK, the second clock signal line GCB, the second start-up voltage signal line ESTV, the third clock signal line ECK and the fourth clock signal line ECB, there are a plurality of first array test pins PIN1 electrically coupled to the first selection signal line MUX1 and the second selection signal line MUX2. In FIG. 5C, the first selection signal line MUX1 and the second selection signal line MUX2 are respectively coupled in one-to-one correspondence with two second pins OUT, and the two second pins OUT are respectively coupled in one-to-one correspondence with two first array test pins PIN1 through two first connection lines W1.

In FIG. 5A, each of the first selection signal line MUX1 and the second selection signal line MUX2 may include two parts, which are located respectively on both sides of the active area 10. For example, the first selection signal line MUX1 includes a first sub-line of first selection signal line located on the left side of the active area 10 and a second sub-line of first selection signal line located on the right side of the active area 10, and the second selection signal line MUX2 includes a first sub-line of second selection signal line on the left side of the active area 10 and a second sub-line of second selection signal line on the right side of the active area 10. As shown in FIGS. 5A and 5C, the first group of first array test pins PIN1 located in the second area 42 are electrically coupled to the first sub-line of first selection signal line (indicated by MUX1 in FIG. 5C) and the first sub-line of second selection signal line (indicated by MUX2 in FIG. 5C). In a similar manner, the second group of first array test pins located in the third area 43 are electrically coupled to the second sub-line of first selection signal line and the second sub-line of second selection signal line, which will not be repeated here.

Figure 6A:
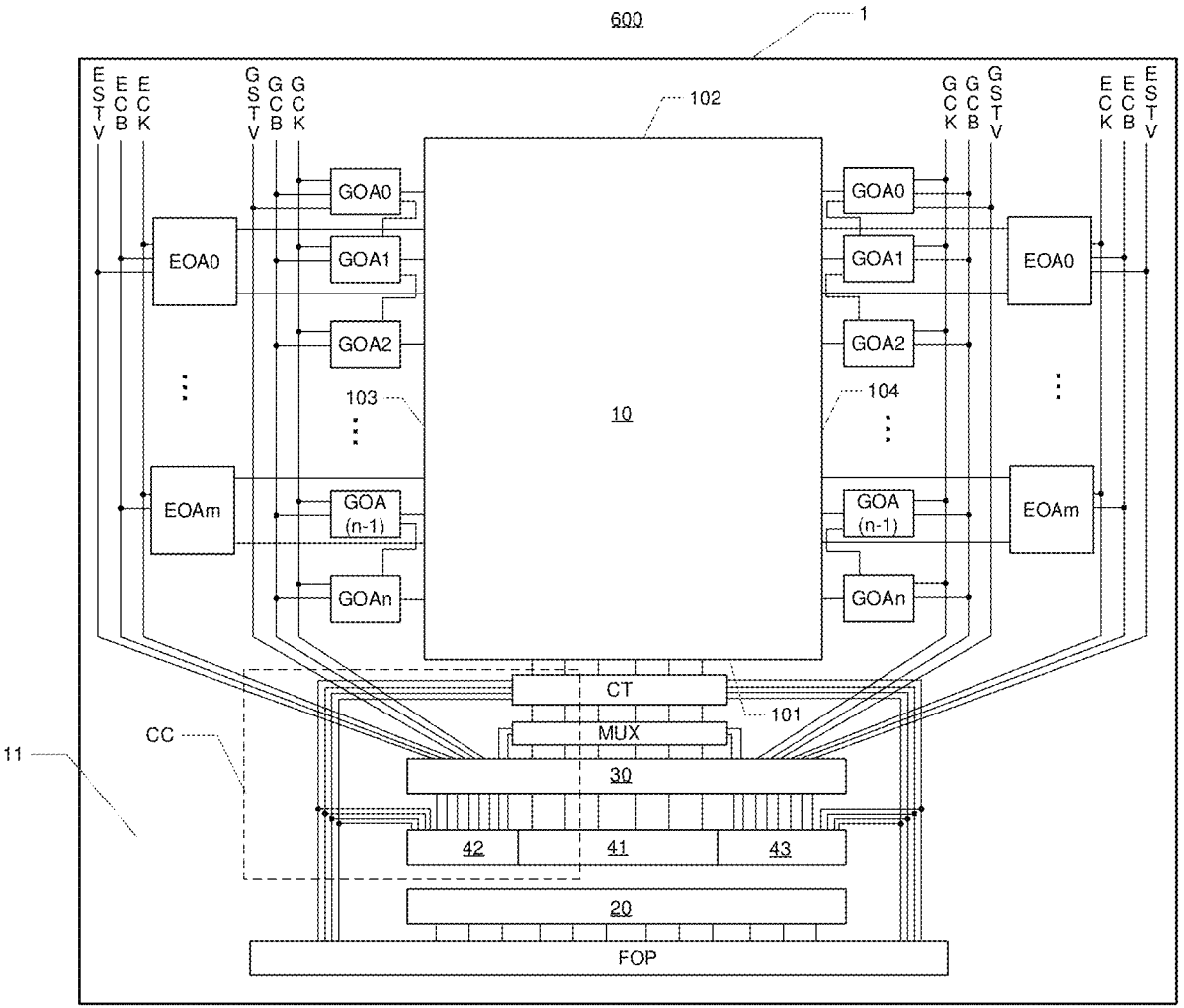
FIG. 6A shows a structural diagram of a display substrate according to another embodiment of the present disclosure.
Figure 6B:
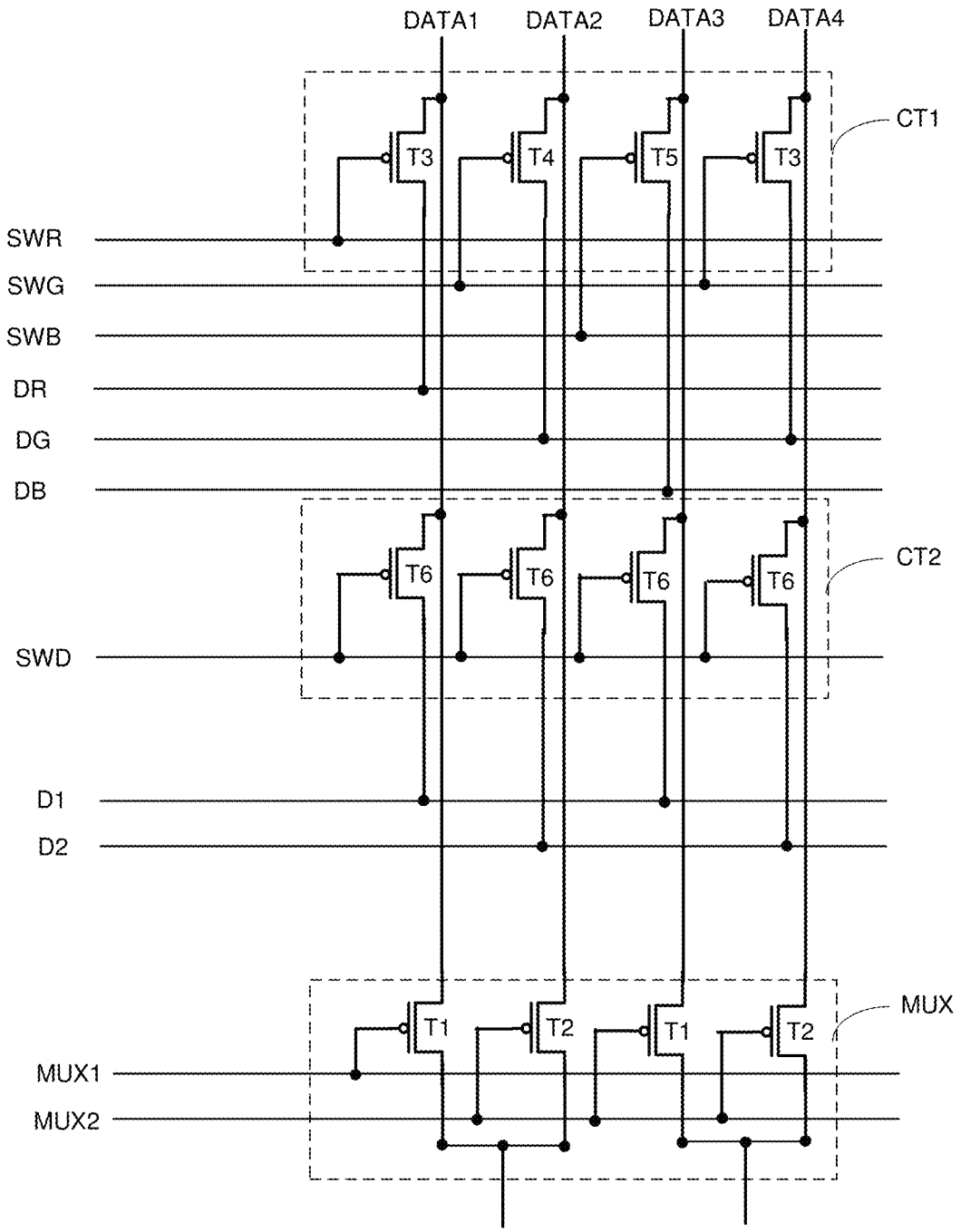
FIG. 6B shows a circuit diagram of a cell test circuit and a multiplex circuit in a display substrate according to an embodiment of the present disclosure.
Figure 6C:
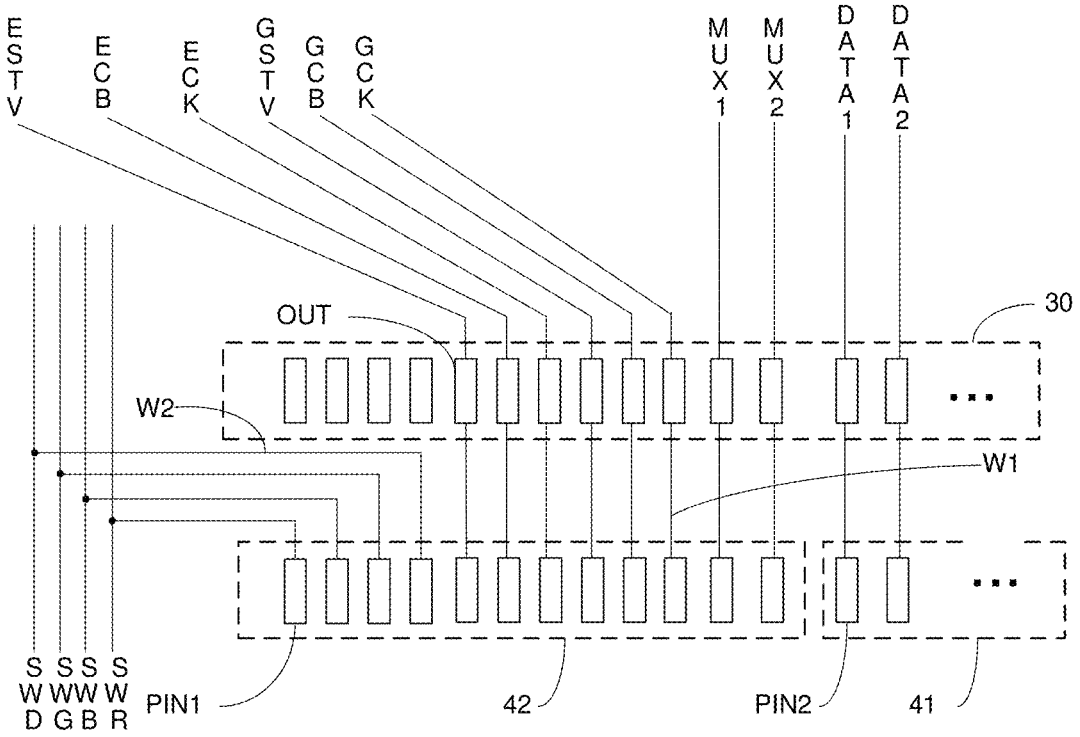
FIG. 6C shows a partial enlarged view of FIG. 6A.

FIG. 6A shows a structural diagram of a display substrate according to another embodiment of the present disclosure. FIG. 6B shows a circuit diagram of a cell test circuit and a multiplex circuit in a display substrate according to an embodiment of the present disclosure. FIG. 6C shows a partial enlarged view of an area indicated by a dashed frame CC in FIG. 6A. The display substrate 600 in FIGS. 6A to 6C is similar to the display substrate 500 in FIGS. 5A to 5C, and difference thereof lies at least in that the display substrate 600 further includes a cell test circuit CT. For the sake of brevity, the difference is mainly described below in detail.

As shown in FIGS. 6A to 6C, a cell test circuit CT, a first switch signal line SWR, a second switch signal line SWG, a third switch signal line SWB, and a fourth switch signal line SWD are also provided in the peripheral area 11 of the display substrate 600. The cell test circuit CT may include a first cell test circuit CT1 and a second cell test circuit CT2. The first cell test circuit CT1 is located between the plurality of second pins (the second pin area 30) and the active area 10, and the second cell test circuit CT2 is located between the plurality of second pins (the second pin area 30) and the first cell test circuit CT1.

As shown in FIG. 6B, the first cell test circuit CT1 includes a plurality of first test sub-circuits, and at least one of the plurality of first test sub-circuits includes a third transistor T3, a fourth transistor T4, and a fifth transistor T5. A gate of the third transistor T3 is electrically coupled to the first switch signal line SWR, a gate of the fourth transistor T4 is electrically coupled to the second switch signal line SWG, and a gate of the fifth transistor T5 is electrically coupled to the third switch signal line SWB. A first electrode of the third transistor T3 is electrically coupled to a first cell test signal line DR, a first electrode of the fourth transistor T4 is electrically coupled to a second cell test signal line DG, and a first electrode of the fifth transistor T5 is electrically coupled to a third cell test signal line DB. Second electrodes of the third transistor T3, the fourth transistor T4, and the fifth transistor T5 are respectively electrically coupled to three data signal lines DATA1, DATA2, and DATA3.

As shown in FIG. 6B, the second cell test circuit CT2 includes a plurality of second test sub-circuits, and at least one of the plurality of second test sub-circuits includes a sixth transistor T6. A gate of the sixth transistor T6 is electrically coupled to the fourth switch signal line SWD, and a first electrode of the sixth transistor is coupled to a fourth cell test signal line. For example, in FIG. 6B, in an array of the second test sub-circuits, the first electrode of the sixth transistor T6 located in first on the left is electrically coupled to the fourth cell test signal line D1, and the first electrode of the sixth transistor located in second on the left is electrically coupled to the fourth cell test signal line D2, and so on. A second electrode of the sixth transistor T6 in each of the second test sub-circuits is electrically coupled to the plurality of data signal lines DATA1, DATA2, . . . .

As shown in FIG. 6C, compared to the display substrate 500, the plurality of array test signal lines of the display substrate 600 further include at least one of the first switch signal line SWR, the second switch signal line SWG, the third switch signal line SWB, and the fourth switch signal line SWD. In FIG. 6C, among the plurality of first array test pins PIN1, in addition to those respectively electrically coupled to the first start-up voltage signal line GSTV, the first clock signal line GCK, the second clock signal line GCB, the second start-up voltage signal line ESTV, the third clock signal line ECK and the fourth clock signal line ECB, the first selection signal line MUX1 and the second selection signal line MUX2, there are a plurality of first array test pins PIN1 respectively electrically coupled to the first switch signal line SWR, the second switch signal line SWG, the third switch signal line SWB, and the fourth switch signal line SWD. In some embodiments, the other part of the plurality of array test signal lines are coupled in one-to-one correspondence with the other part of the plurality of first array test pins PIN1 through a plurality of second connection lines W2. For example, in FIG. 6C, the first switch signal line SWR, the second switch signal line SWG, the third switch signal line SWB, and the fourth switch signal line SWD are respectively electrically coupled in one-to-one correspondence with four first array test pins PIN1 through four second connection lines W2.

Each of the first switch signal line SWR, the second switch signal line SWG, the third switch signal line SWB, and the fourth switch signal line SWD includes two parts, which are located respectively on both sides of the active area 10. For example, the first switch signal line SWR includes a first sub-line of first switch signal line and a second sub-line of first switch signal line located respectively on the left and right sides of the active area 10, the second switch signal line SWG includes a first sub-line of second switch signal line and a second sub-line of second switch signal line located respectively on the left and right sides of the active area 10, the third switch signal line SWB includes a first sub-line of third switch signal line and a second sub-line of third switch signal line located respectively on the left and right sides of the active area 10, and the fourth switch signal line SWD includes a first sub-line of fourth switch signal line and a second sub-line of fourth switch signal line located respectively on the left and right sides of the active area 10.

As shown in FIG. 6C, the first sub-line of first switch signal line (indicated by SWR in FIG. 6C), the first sub-line of second switch signal line (indicated by SWG in FIG. 6C), the first sub-line of third switch signal line (indicated by SWB in FIG. 6C) and the first sub-line of fourth switch signal line (indicated by SWD in FIG. 6C) that are located on the left side of the active area 10 are electrically coupled to four first array test pins PIN1 in the first group of first array test pins PIN1 in the second area 42. In a similar manner, the second sub-line of first switch signal line, the second sub-line of second switch signal line, the second sub-line of third switch signal line, and the second sub-line of fourth switch signal line located on the right side of the active area 10 are electrically coupled to four first array test pins PIN1 in the second group of first array test pins PIN1 in the third area 43.

Figure 7A:
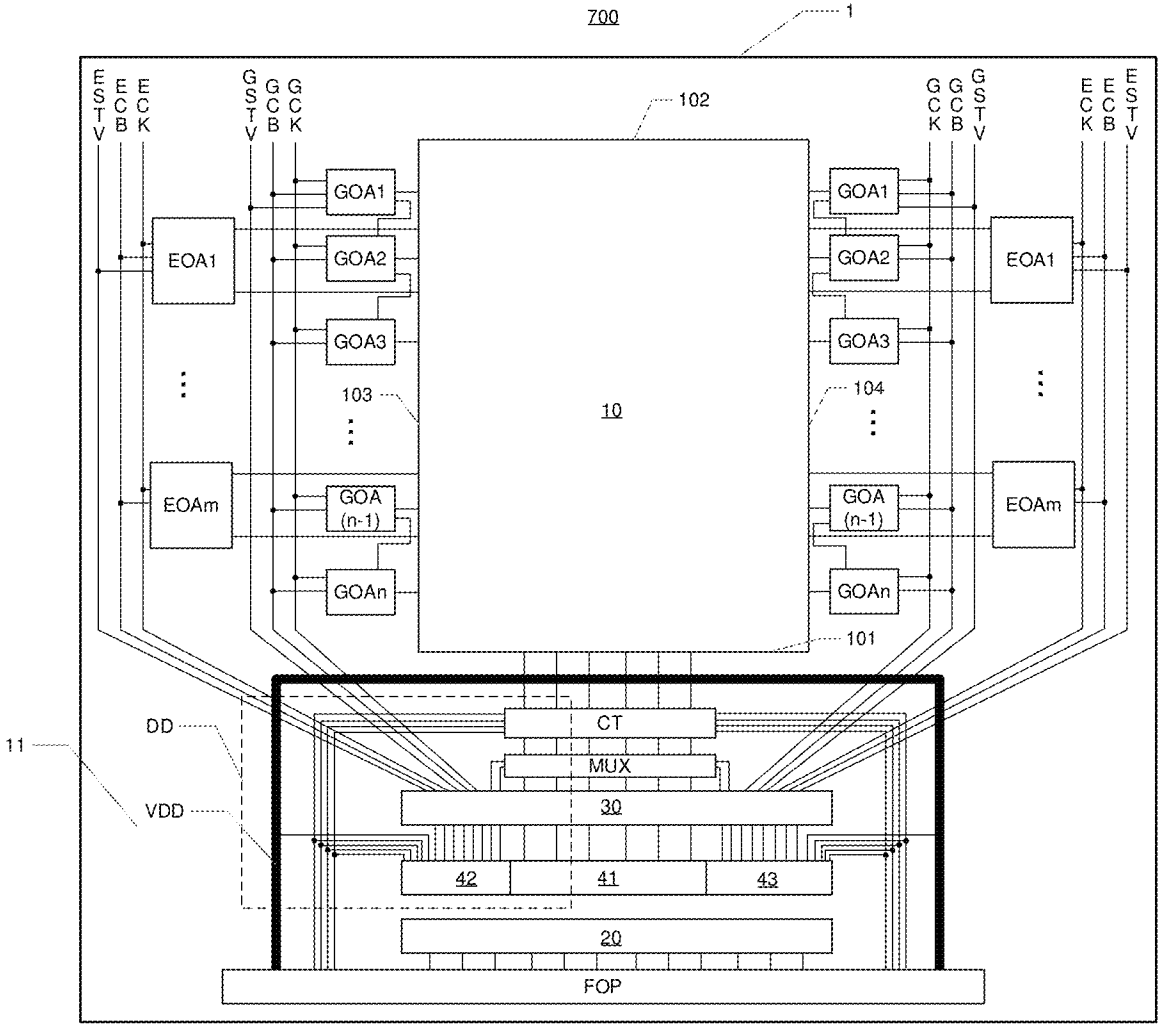
FIG. 7A shows a structural diagram of a display substrate according to another embodiment of the present disclosure.
Figure 7B:
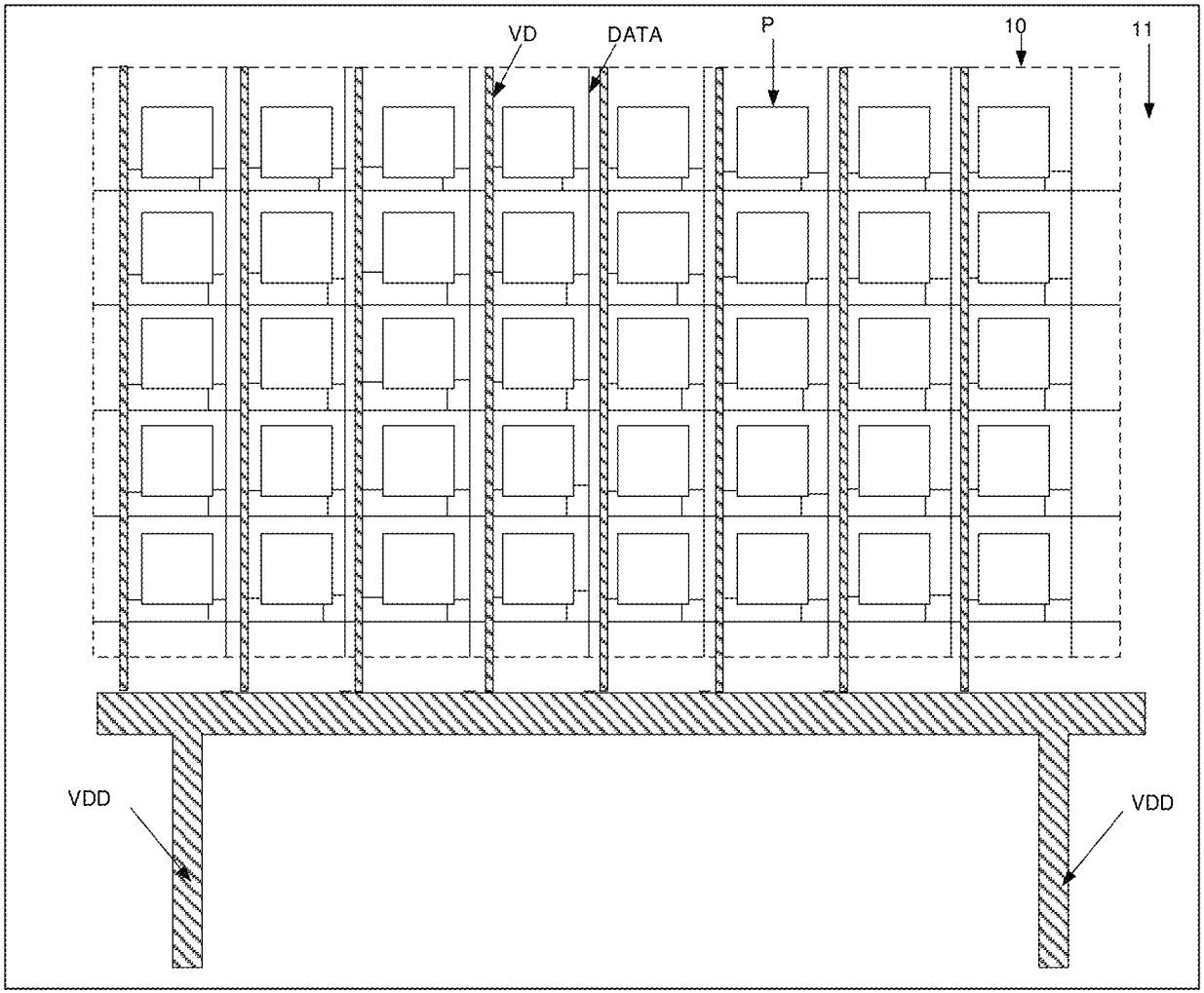
FIG. 7B shows a schematic diagram of a first power bus and a first power line in a display substrate according to an embodiment of the present disclosure.
Figure 7C:
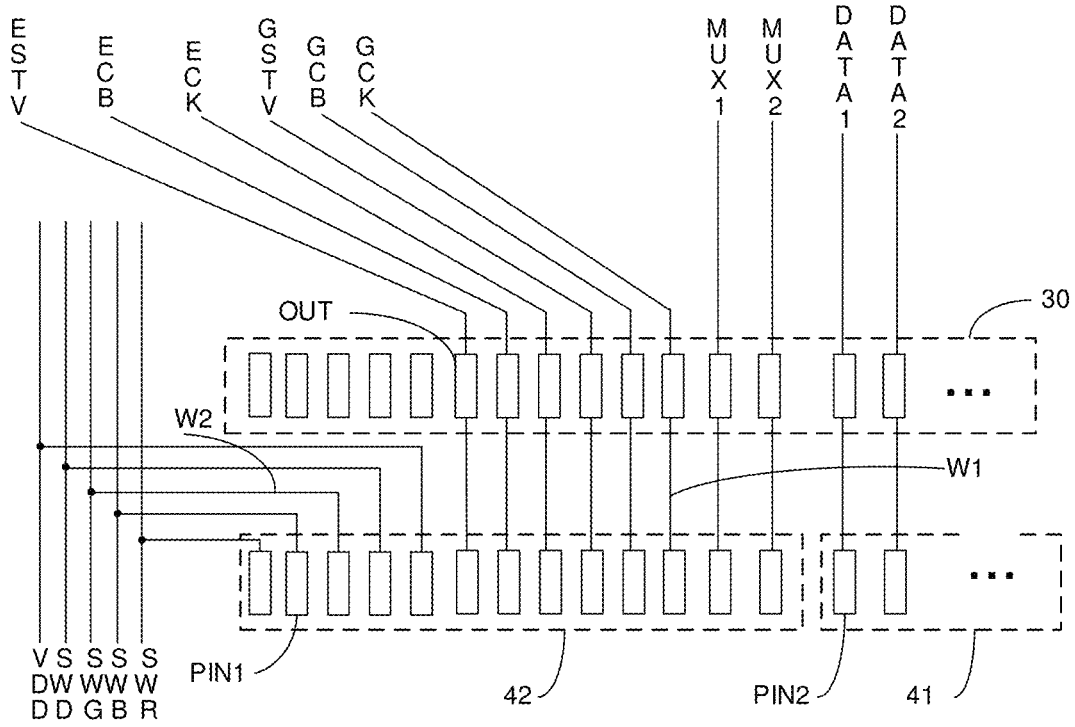
FIG. 7C shows a partial enlarged view of FIG. 7A.

FIG. 7A shows a structural diagram of a display substrate according to another embodiment of the present disclosure. FIG. 7B shows a schematic diagram of a first power bus and a first power line in a display substrate according to an embodiment of the present disclosure. FIG. 7C shows a partial enlarged view of an area indicated by a dotted line DD in FIG. 7A. The display substrate 700 in FIGS. 7A to 7C is similar to the display substrate 600 in FIGS. 6A to 6C, and difference thereof lies at least in that the display substrate 700 further includes a first power bus VDD. For the sake of brevity, the difference is mainly described below in detail.

As shown in FIGS. 7A and 7B, the display substrate 700 further includes a plurality of first power lines VD located in the active area 10 and a first power bus VDD located in the peripheral area 11 close to the first boundary (the lower boundary) of the active area 10, and the plurality of first power lines VD are electrically coupled to the first power bus VDD. For example, in FIG. 7B, in the active area 10, each column of sub-pixels P is electrically coupled to a first power line VD, and the plurality of first power lines VD respectively electrically coupled to multiple columns of sub-pixels P are led out from the active area 10 to be coupled to the first power bus VDD located in the peripheral area 11.

As shown in FIG. 7C, in the display substrate 700, as compared to the display substrate 600, the plurality of array test signal lines further include the first power bus VDD. Among the plurality of first array test pins PIN1, in addition to those respectively electrically coupled to the first start-up voltage signal line GSTV, the first clock signal line GCK, the second clock signal line GCB, the second start-up voltage signal line ESTV, the third clock signal line ECK and the fourth clock signal line ECB, the first selection signal line MUX1, the second selection signal line MUX2, the first switch signal line SWR, the second switch signal line SWG, the third switch signal line SWB, and the fourth switch signal line SWD, there is at least one first array test pin PIN1 coupled to the first power bus VDD. In FIG. 7C, the first switch signal line SWR, the second switch signal line SWG, the third switch signal line SWB, the fourth switch signal line SWD, and the first power bus VDD are respectively electrically coupled in one-to-one correspondence with five first array test pins PIN1 through five second connection lines W2.

In some embodiments, the first power bus VDD may include a first sub-line of first power bus and a second sub-line of first power bus. For example, in FIGS. 7A and 7B, the first power bus VDD may include a first part extending in a horizontal direction and two second parts extending in a vertical direction, and the two second parts are located respectively on the left and right sides of the display substrate 700. The second part on the left may be used as the first sub-line of first power bus, and the second part on the right may be used as the second sub-line of first power bus.

As shown in FIG. 7C, the first sub-line of first power bus on the left (indicated by VDD in FIG. 7C) is electrically coupled to the first group of first array test pins PIN1 in the second area 42. In a similar manner, the second sub-line of first power bus on the right is electrically coupled to the second group of first array test pins PIN1 in the third area 43, which will not be repeated here.

Figure 8A:
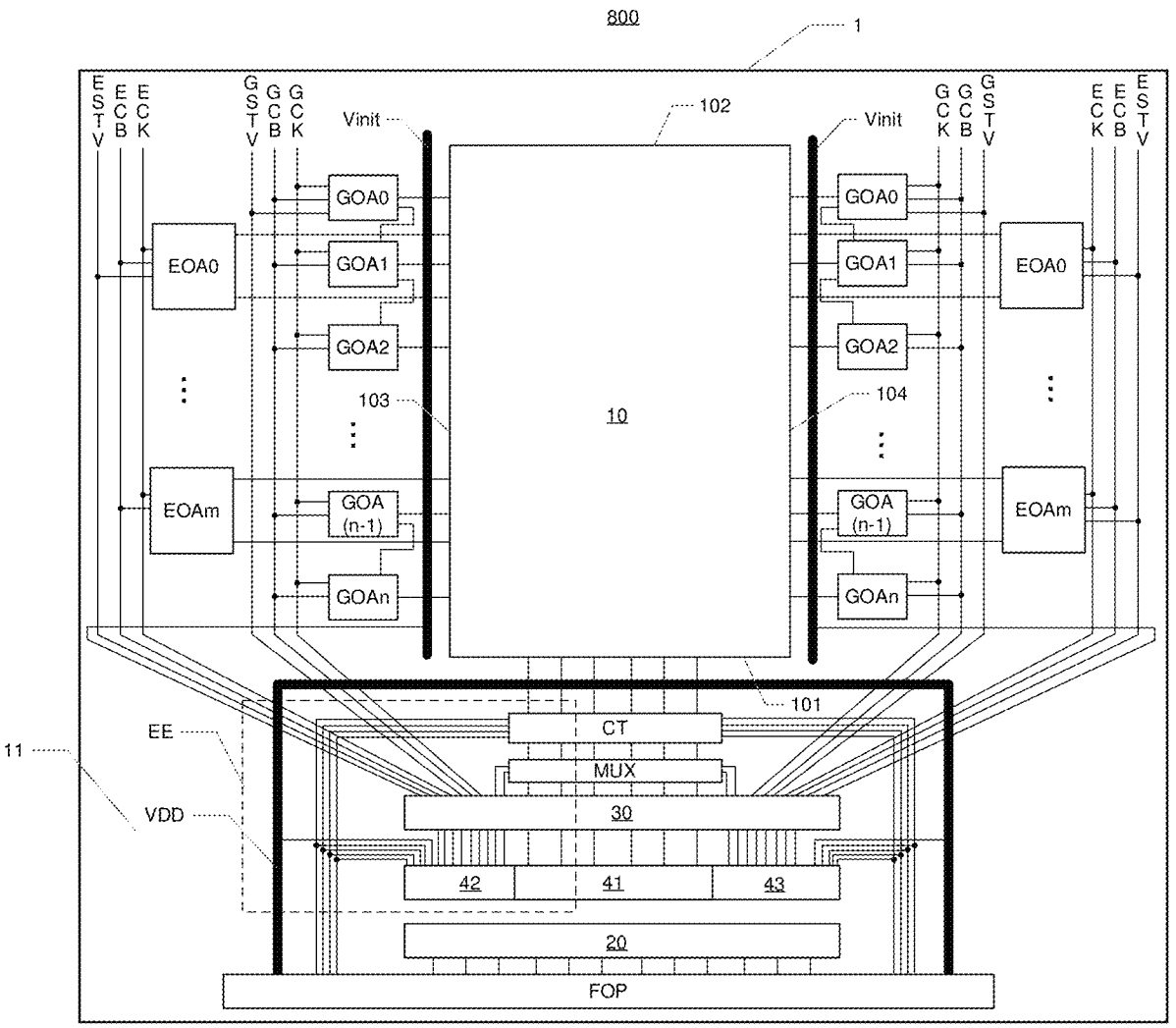
FIG. 8A shows a structural diagram of a display substrate according to another embodiment of the present disclosure.
Figure 8B:
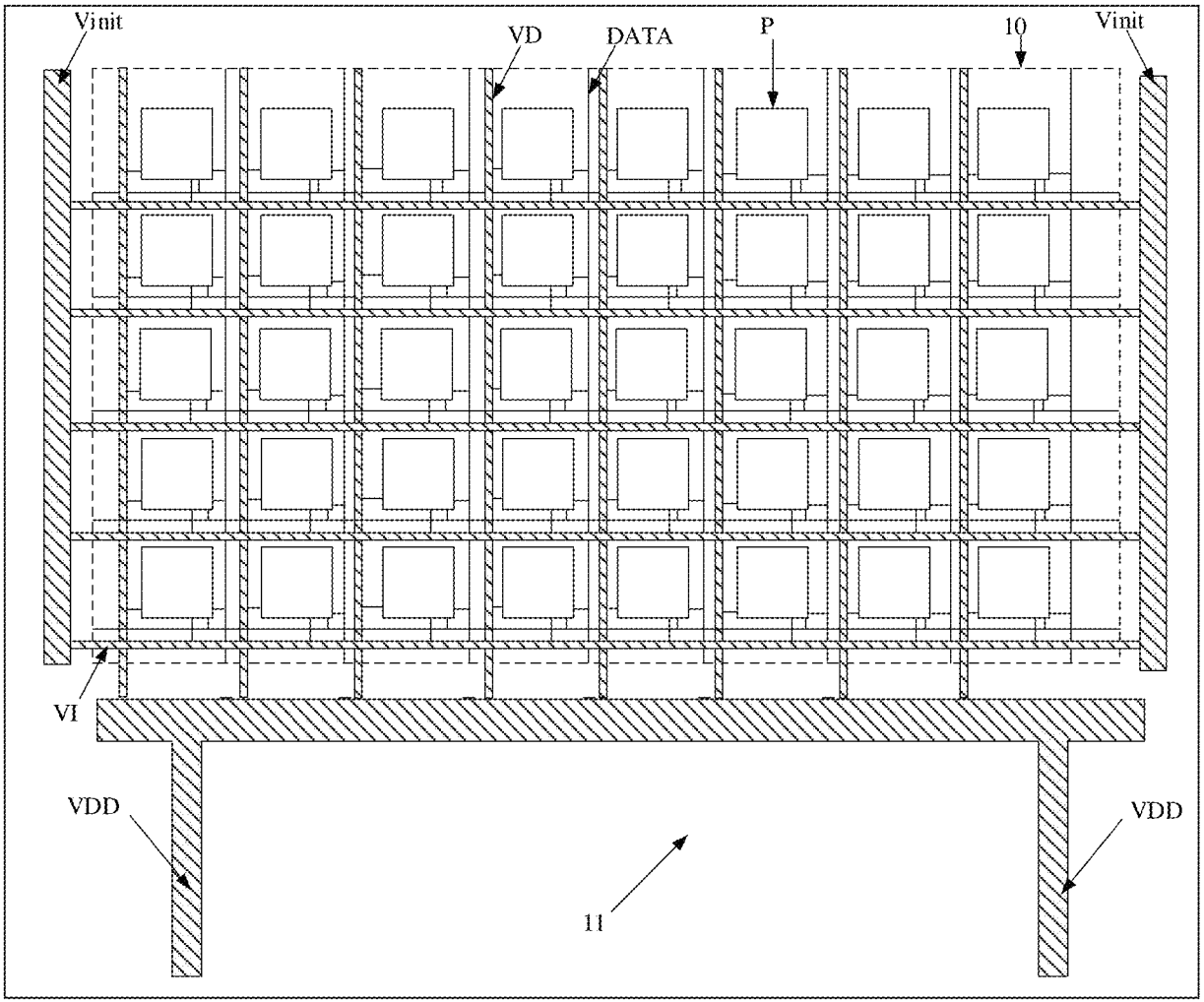
FIG. 8B shows a schematic diagram of an initial voltage signal bus and an initial voltage signal line in a display substrate according to an embodiment of the present disclosure.
Figure 8C:
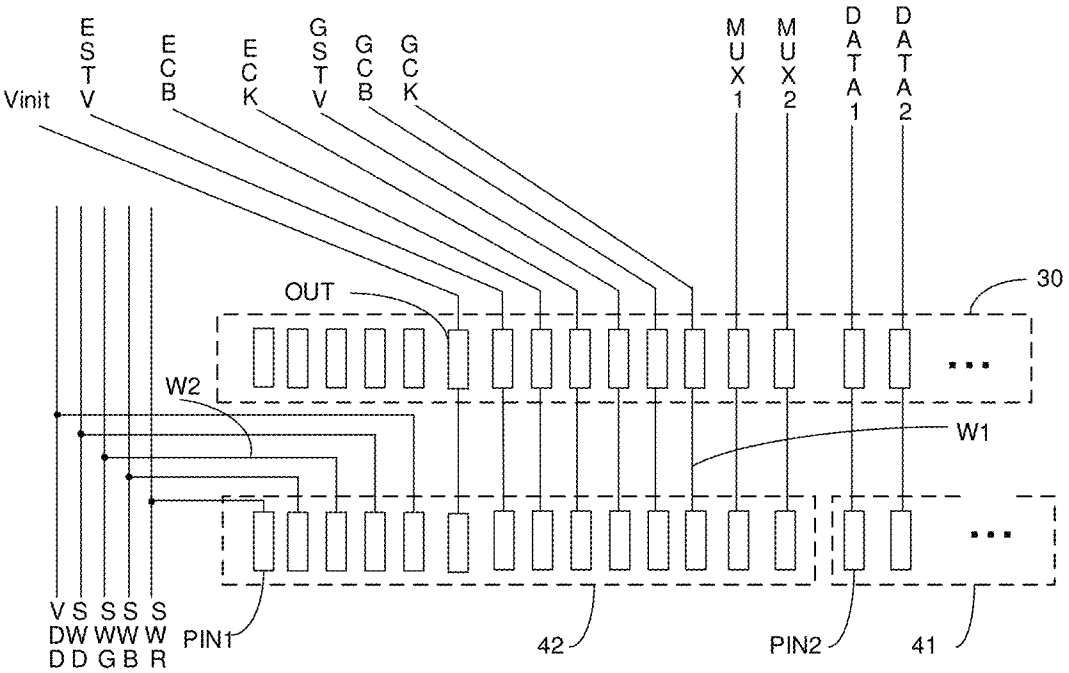
FIG. 8C shows a partial enlarged view of FIG. 8A.

FIG. 8A shows a structural diagram of a display substrate according to another embodiment of the present disclosure. FIG. 8B shows a schematic diagram of an initial voltage signal bus and an initial voltage signal line in a display substrate according to an embodiment of the present disclosure. FIG. 8C shows a partial enlarged view of an area indicated by a dashed frame EE in FIG. 8A. The display substrate 800 in FIGS. 8A to 8C is similar to the display substrate 700 in FIGS. 7A to 7C, and difference thereof lies at least in that the display substrate 800 further includes an initial voltage signal bus Vinit. For the sake of brevity, the difference is mainly described below in detail.

As shown in FIGS. 8A and 8B, the display substrate 800 further includes a plurality of initial voltage signal lines VI located in the active area 10 and an initial voltage signal bus Vinit located in the peripheral area 11. The initial voltage signal bus Vinit is located between the gate driving circuit (GOA0, GOA1, . . . , GOAn) and the active area 10. For example, in FIG. 8B, in the active area 10, each row of sub-pixels P is electrically coupled to an initial voltage signal line VI, and a plurality of initial voltage signal lines VI electrically coupled to multiple rows of sub-pixels P are led out from the active area 10, to be coupled to the initial voltage signal bus Vinit located in the peripheral area 11.

In the display substrate 800, as compared to the display substrate 700, the plurality of array test signal lines further include an initial voltage signal bus Vinit. As shown in FIG. 8C, among the plurality of first array test pins PIN1, in addition to those respectively electrically coupled to first start-up voltage signal line GSTV, the first clock signal line GCK, the second clock signal line GCB, the second start-up voltage signal line ESTV, the third clock signal line ECK and the fourth clock signal line ECB, the first selection signal line MUX1, the second selection signal line MUX2, the first switch signal line SWR, the second switch signal line SWG, the third switch signal line SWB, the fourth switch signal line SWD, and first power bus VDD, there is at least one first array test pin PIN1 electrically coupled to the initial voltage signal bus Vinit. In FIG. 8C, the initial voltage signal bus Vinit is electrically coupled to a second pin OUT, and the second pin OUT is electrically coupled to a first array test pin PIN1 through one first connection line W1.

In some embodiments, as shown in FIGS. 8A and 8B, the initial voltage signal bus Vinit may include a first sub-line of initial voltage signal bus and a second sub-line of initial voltage signal bus, and the first sub-line of initial voltage signal bus and the second sub-line of initial voltage signal bus are located respectively in the peripheral area 11 close to the second boundary (the left boundary) and the fourth boundary (the right boundary) of the active area 10. In FIG. 8C, the first sub-line of initial voltage signal bus (indicated by Vinit in FIG. 8C) located on the left side of the active area 10 is electrically coupled to the first group of first array test pins PIN1 in the second area 42. In a similar manner, the second sub-line of initial voltage signal bus is electrically coupled to the second group of first array test pins PIN1 in the third area 43, which will not be repeated here.

Figure 9A:
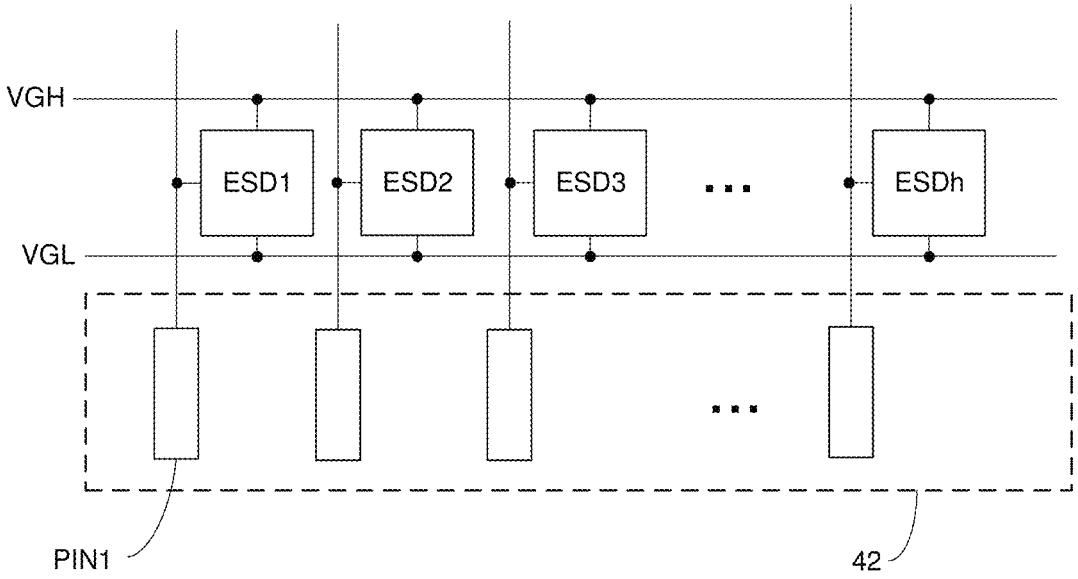
FIG. 9A shows a schematic diagram of an electrostatic discharge circuit in a display substrate according to an embodiment of the present disclosure.
Figure 9B:
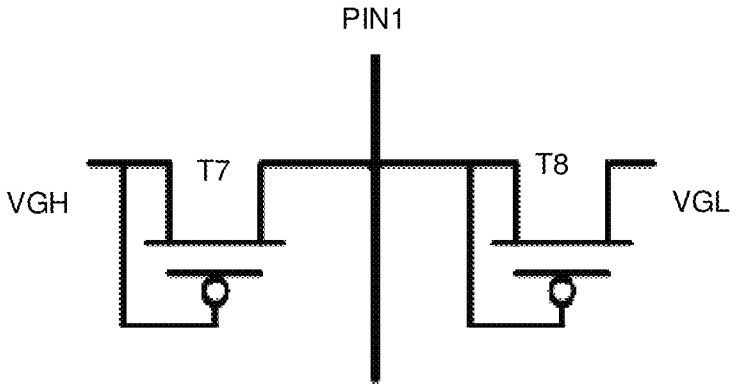
FIG. 9B shows a circuit diagram of an electrostatic discharge unit of an electrostatic discharge circuit according to an embodiment of the present disclosure.

FIG. 9A shows a schematic diagram of an electrostatic discharge circuit in a display substrate according to an embodiment of the present disclosure. FIG. 9B shows a circuit diagram of an electrostatic discharge unit of an electrostatic discharge circuit according to an embodiment of the present disclosure. The electrostatic discharge circuit of FIGS. 9A and 9B can be applied to the display substrate of any of the above embodiments.

As shown in FIGS. 9A and 9B, the display substrate further includes an electrostatic discharge circuit. The electrostatic discharge circuit includes a plurality of electrostatic discharge units ESD1, ESD2, . . . , ESDh. The plurality of electrostatic discharge units ESD1, ESD2, . . . , ESDh are located between the plurality of first array test pins PIN1 and the plurality of second pins located in the second pin area 30 and are coupled in one-to-one correspondence with the plurality of first array test pins PIN1. As shown in FIG. 9B, each of the electrostatic discharge units ESD1, ESD2, . . . , ESDh includes a seventh transistor T7 and an eighth transistor T8. A gate and a first electrode of the seventh transistor are coupled to a high voltage signal line VGH. A gate and a second electrode of the eighth transistor are coupled to a low voltage signal line VGL. A second electrode of the seventh transistor T7 and the gate and a first electrode of the eighth transistor T8 are electrically coupled to the first array test pins PIN1. When a high level of a signal at the first array test pin PIN1 is higher than a preset value of high level, the seventh transistor T7 is turned on to control the first array test pin PIN1 to be at the potential of the high voltage signal line VGH, so that an excessive high level is released through the seventh transistor T7. When a low level of a signal at the first array test pin PIN1 is lower than a preset value of low level, the eighth transistor T8 is turned on to control the first array test pin PIN1 to be at the potential of the low voltage signal line VGL, so that a too low level is released through the eighth transistor T8.

Figure 10A:
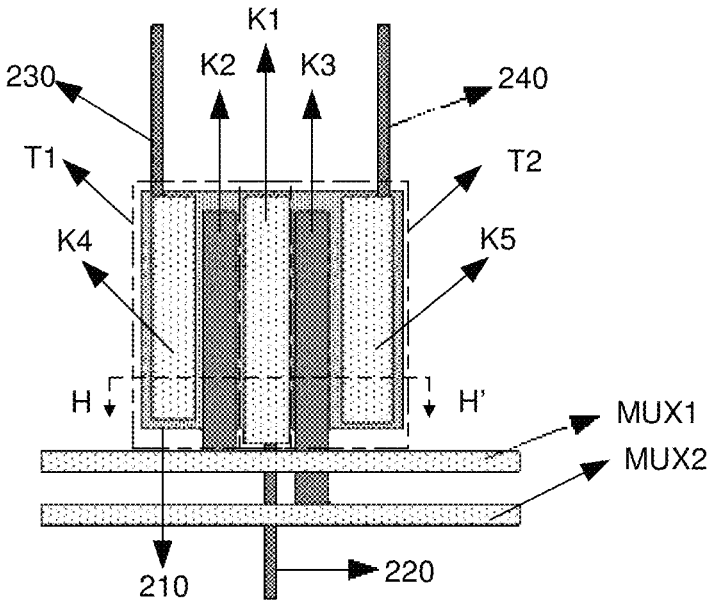
FIG. 10A shows a layout diagram of a multiplex circuit according to an embodiment of the present disclosure.

FIG. 10A shows a layout diagram of a multiplex switch in a multiplex circuit according to an embodiment of the present disclosure. As shown in FIG. 10A, a multiplex switch includes a first transistor T1 and a second transistor T2 (indicated by a dashed box). The first transistor T1 and the second transistor T2 share a first electrode of the transistor. As shown in FIG. 10A, 210 represents an active layer for forming active regions of the first transistor T1 and the second transistor T2. K1 represents the first electrode of the first transistor T1 and the second transistor T2 electrically coupled together. K2 represents a gate of the first transistor T1. K3 represents a gate of the second transistor T2. K4 represents a second electrode of the first transistor T1. K5 represents a second electrode of the second transistor T2. In FIG. 10A, a first control line MUX1 extends in the horizontal direction and is electrically coupled to K2, and a second control line MUX2 is provided in the horizontal direction and is electrically coupled to K3. A lead 220 is electrically coupled to K1 for electrically coupling the first electrode of the first transistor T1 and the first electrode of the second transistor T2 to a pin (for example, a second pin) of a chip used to output a data signal. A lead 230 is electrically coupled to K4 for sending the data signal received by the first transistor T1 to the data line in the active area. A lead 240 is electrically coupled to K5 for sending the data signal received by the second transistor T2 to the data line in the active area.

Figure 10B:
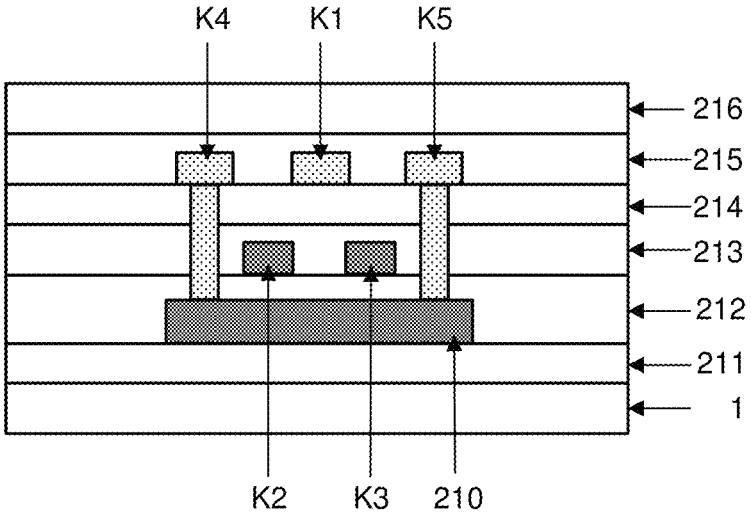
FIG. 10B shows a structural diagram of a multiplex circuit according to an embodiment of the present disclosure.

FIG. 10B shows a sectional view taken along the line HH' in FIG. 10A. As shown in FIG. 2C, a buffer layer 211, a first gate insulating layer 212, a second gate insulating layer 213, an interlayer insulating layer 214, a passivation layer 215, and a first planarization layer 216 are sequentially stacked on the base substrate 1. The active layer 210 is located between the buffer layer 211 and the first gate insulating layer 212. The gate K2 of the first transistor T1 and the gate K3 of the second transistor T2 are located between the first gate insulating layer 212 and the second gate insulating layer 213. The first electrode K1 shared by the first transistor T1 and the second transistor T2, the second electrode K4 of the first transistor T1 and the second electrode K5 of the second transistor T2 are located between the interlayer insulating layer 214 and the passivation layer 215. The second electrode K4 of the first transistor T1 and the second electrode K5 of the second transistor T2 are respectively coupled to the active layer 210 through via holes, and the via holes sequentially pass through the first gate insulating layer 212, the second gate insulating layer 213 and the interlayer insulating layer 214.

The active layer 210 used for forming the active regions of the first transistor T1 and the second transistor T2 are located in the same layer as a driving active layer of the driving thin film transistor included in at least one of the plurality of sub-pixels P located in the active area 10 mentioned above. The gate K2 of the first transistor T1 and the gate K3 of the second transistor T2 are located in the same layer as a driving gate of the driving thin film transistor included in at least one of the plurality of sub-pixels P located in the active area 10 mentioned above. The first electrode K1 shared by the first transistor T1 and the second transistor T1, the second electrode K4 of the first transistor T1, and the second electrode K5 of the second transistor T2 are located in the same layer as a driving source and a driving drain of the driving thin film transistor included in at least one of the plurality of sub-pixels P located in the active area 10 mentioned above.

Figure 11A:
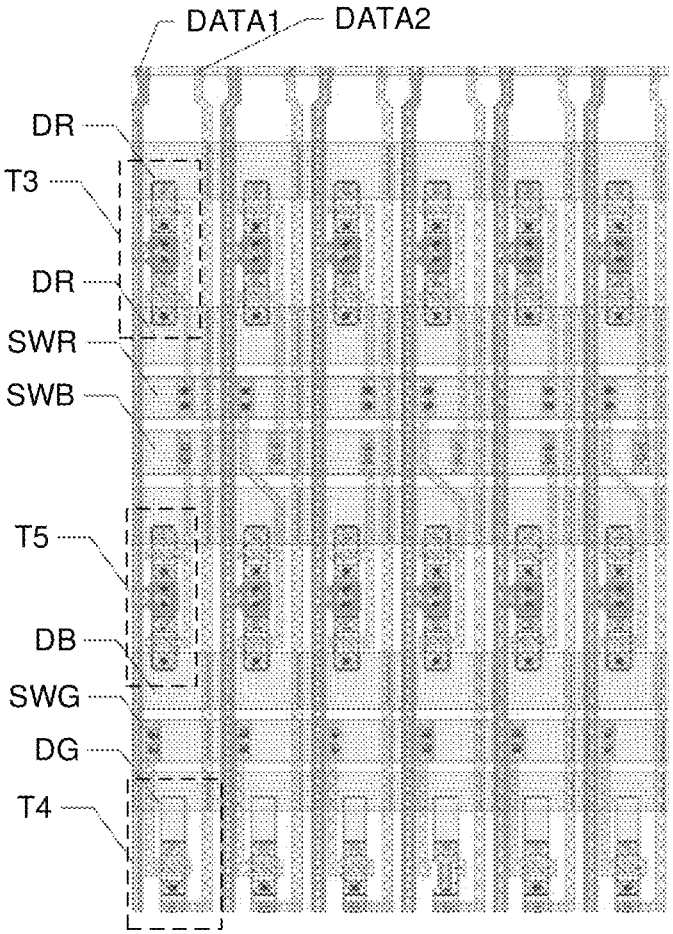
FIG. 11A shows a layout diagram of a first array test circuit according to an embodiment of the present disclosure.

FIG. 11A shows a layout diagram of a first array test circuit according to an embodiment of the present disclosure. As shown in FIG. 11A, the first cell test circuit CT1 includes a plurality of first test sub-circuits, and each of the first test sub-circuits includes a third transistor T3, a fourth transistor T4, and a fifth transistor T5. A gate of the third transistor T3 is electrically coupled to the first switch signal line SWR, a gate of the fourth transistor T4 is electrically coupled to the second switch signal line SWG, and a gate of the fifth transistor T5 is electrically coupled to the third switch signal line SWB. A first electrode of the third transistor T3 is electrically coupled to the first cell test signal line DR, a first electrode of the fourth transistor T4 is electrically coupled to the second cell test signal line DG, and a first electrode of the fifth transistor T5 is electrically coupled to the third cell test signal line DB. A second electrode of the third transistor T3 and a second electrode of the fourth transistor T4 are electrically coupled to one data line DATA1, and a second electrode of the fifth transistor T5 is electrically coupled to another data line DATA2. Herein, DATA1 and DATA2 are only used to indicate two different data lines, and are not intended to limit an arrangement order of the data lines.

Figure 11B:
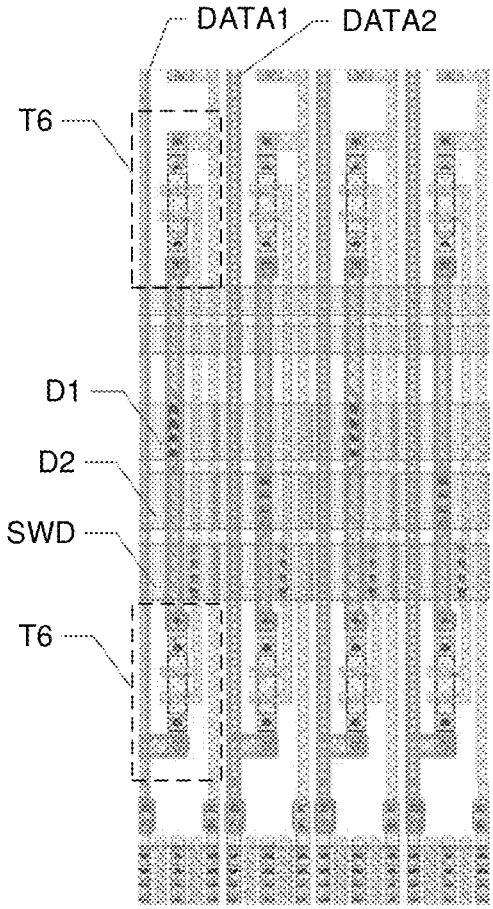
FIG. 11B shows a layout diagram of a second array test circuit according to an embodiment of the present disclosure.

FIG. 11B shows a layout diagram of a second array test circuit according to an embodiment of the present disclosure. As shown in FIG. 11B, the second cell test circuit CT2 includes a plurality of second test sub-circuits, and each of second test sub-circuit includes a sixth transistor T6, and a gate of the sixth transistor T6 is electrically coupled to the fourth switch signal line SWD. In FIG. 11B, in an array of the second test sub-circuits, the first electrode of the sixth transistor T6 located in first on the left is electrically coupled to the fourth cell test signal line D1, and the first electrode of the sixth transistor located in second on the left is electrically coupled to the fourth cell test signal line D2, and so on. A second electrode of the sixth transistor T6 in each of the second test sub-circuits is electrically coupled to the plurality of data signal lines DATA1, DATA2, . . . .

Figure 12:
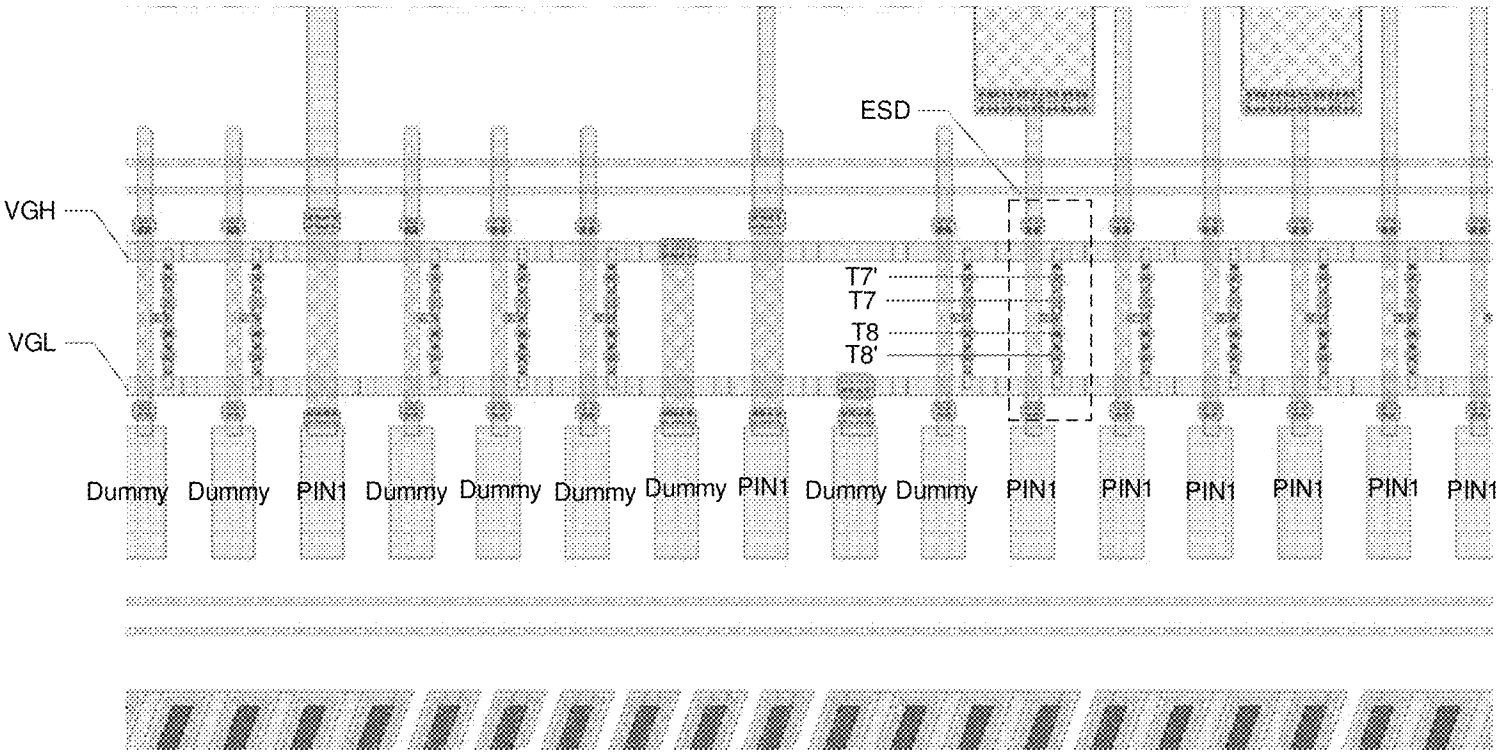
FIG. 12 shows a layout diagram of an electrostatic discharge circuit according to an embodiment of the present disclosure.

FIG. 12 shows a layout diagram of an electrostatic discharge circuit according to an embodiment of the present disclosure. As shown in FIG. 12, the electrostatic discharge circuit includes a plurality of electrostatic discharge units ESD, and one of the electrostatic discharge units is marked with a dashed frame in FIG. 12. The electrostatic discharge unit ESD is electrically coupled to the plurality of first array test pins PIN1. In FIG. 12, the plurality of first array test pins PIN1 from left to right are the first array test pins PIN1 sequentially used for electrical coupling with VDD, Vinit, ESTV, ECB, ECK, GSTV, and GCB. Among which, two first array test pins that are electrically coupled to VDD and Vinit are not coupled to the electrostatic discharge unit. Although above embodiments illustrate a positional relationship of the signal lines VDD, Vinit, ESTV, ECB, ECK, GSTV, and GCB in a specific order, the embodiments of the present disclosure are not limited thereto, and these signal lines may be arranged in other order as needed.

FIG. 12 also shows a plurality of dummy array test pins Dummy. The dummy array test pins Dummy are not electrically coupled to other circuit structures in the display substrate, so that the quantity and arrangement of respective pins of the first area 41, the second area 42 and the third area 43 may be set as required. On one hand, a layout of the array test pins on the array substrate can be more easily matched with a pin layout of the testing equipment, thereby achieving a good coupling. On the other hand, the quantity of pins in the second area 42 and the third area 43 can be made to be equal, thereby improving the symmetry of the pin layout. In addition, providing the dummy array test pins Dummy also helps to improve the process uniformity. In FIG. 12, at least part of the dummy array test pins Dummy are also coupled to electrostatic discharge units.

As shown in FIG. 12, the electrostatic discharge unit ESD includes four transistors coupled in series, that is, in addition to the seventh transistor T7 and the eighth transistor T8 described above, it may also include two other transistors T7' and T8'. A gate and a first electrode of the transistor T7' are coupled to the high voltage signal line VGH, and a second electrode of the transistor T7' is coupled to the gate and the first electrode of the seventh transistor T7. A second electrode of the transistor T8' is coupled to the low voltage signal Line VGL, and a gate and a first electrode of the transistor T8' are coupled to the second electrode of the eighth transistor T8. The second electrode of the seventh transistor T7 and the gate and the first electrode of the eighth transistor T8 are electrically coupled to an array test pin PIN1 or a redundant array test pin Dummy.

Figure 13:
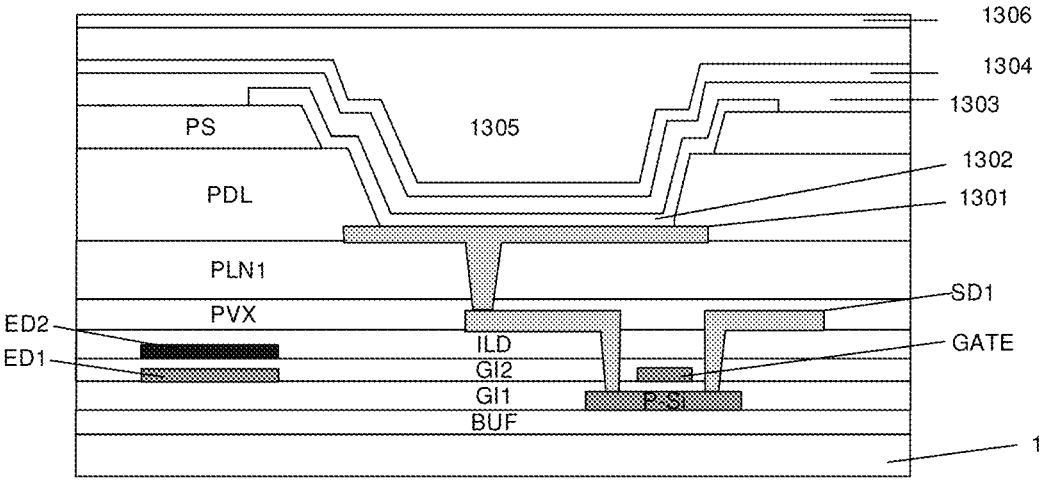
FIG. 13 shows a schematic diagram of a pixel structure according to an embodiment of the present disclosure.

FIG. 13 shows a schematic diagram of a pixel structure according to an embodiment of the present disclosure. As shown in FIG. 13, at least one of the plurality of sub-pixels in the display substrate includes a driving thin film transistor and a storage capacitor.

The driving thin film transistor may include a driving active layer P-Si located on a base substrate, a driving gate GATE located on a side of the driving active layer P-Si away from the base substrate, a gate insulating layer GI2 (second gate insulating layer) located on a side of the driving gate GATE far from the base substrate, an interlayer dielectric layer ILD located on a side of the gate insulating layer GI2 away from the base substrate, and a driving source and a driving drain SD1 located on a side of the interlayer dielectric layer ILD away from the base substrate.

The storage capacitor may include a first capacitor electrode ED1 and a second capacitor electrode ED2. The first capacitor electrode ED1 is located in the same layer as the driving gate GATE, and the second capacitor electrode ED2 is located between the gate insulating layer GI2 and the interlayer dielectric layer ILD.

In addition, the sub-pixel may also include a first gate insulating layer GI1, a barrier layer BUF, a passivation layer PVX, a planarization layer PLN1, a pixel defining layer PDL, a light blocking layer PS, an anode 1301, a light emitting layer 1302, a cathode 1303, and a first inorganic encapsulation layer 1304, an organic encapsulation layer 1305 and a second inorganic encapsulation layer 1306. The barrier layer BUF is located between a base substrate 1 and the driving active layer P-Si. The first gate insulating layer GI1 is located on a side of the barrier layer BUF away from the base substrate 1, so that the driving active layer P-Si is located between the first gate insulating layer GI1 and the barrier layer BUF. The passivation layer PVX is located on a side of the interlayer dielectric layer ILD away from the base substrate 1. The planarization layer PLN1 is located on a side of the passivation layer PVX away from the base substrate 1. The anode 1301 is located on a side of the planarization layer PLN1 away from the base substrate and passes through the planarization layer PLN1 and the passivation layer PVX to be electrically coupled to the driving source or the driving drain SD1. The pixel defining layer PDL is located on a side of the planarization layer PNL1 away from the base substrate 1 and partially covers the anode 1301. The light blocking layer PS is located on a side of the pixel defining layer PDL away from the base substrate 1 and partially covers the pixel defining layer PDL. The light emitting layer 1302 partially covers the anode 1301, the pixel defining layer PDL, and the light blocking layer PS. The cathode 1303 is located on a side of the light-emitting layer 1302 away from the base substrate 1. On a side of the cathode 1303 away from the base substrate 1, the first inorganic encapsulation layer 1304, the organic encapsulation layer 1305, and the second inorganic encapsulation layer 1306 are sequentially arranged.

At least one layer of the plurality of first array test pins PIN1 and the plurality of second array test pins PIN2 in foregoing embodiment may be located in the same layer as the driving sources and driving drains SD1 of the plurality of sub-pixels in the active area. The plurality of first connection lines W1 in above embodiment may be located in the same layer as the driving sources and driving drains SD1 of the plurality of sub-pixels in the active area.

In above embodiment, each of the plurality of second connection lines W2 is partly located in the same layer as the driving sources and driving drains SD1 of the plurality of sub-pixels in the active area, and partly located in the same layer as the driving gates GATE of the plurality of sub-pixels in the active area.

The display substrate according to the embodiment of the present disclosure may further include an anisotropic conductive film ACF that covers the plurality of first array test pins and the plurality of second array test pins.

An embodiment of the present disclosure also provides a display panel, including the display substrate of any of the foregoing embodiments.

Figure 14:
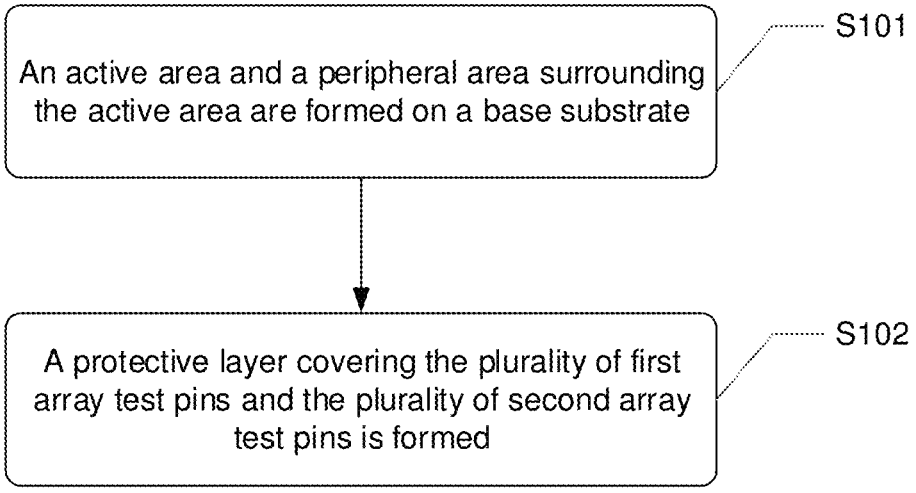
FIG. 14 shows a flowchart of a manufacturing method of a display substrate according to an embodiment of the present disclosure.

FIG. 14 shows a flowchart of a manufacturing method of a display substrate according to an embodiment of the present disclosure.

In step S101, an active area and a peripheral area surrounding the active area are formed on a base substrate. The active area and the peripheral area may be provided based on any of the above embodiments. For example, a plurality of sub-pixels, a plurality of data lines, and a plurality of gate lines may be provided in the active area in a manner as described in above embodiment. A first scanning gate driving circuit, a first start-up voltage signal line, a first clock signal line, a second clock signal line, a plurality of first pins, a plurality of second pins, a plurality of first array test pins, and a plurality of second array test pins may be provided in the peripheral area in a manner as described in above embodiment.

In step S102, a protective layer covering the plurality of first array test pins and the plurality of second array test pins is formed, and the protective layer includes but not limited to an anisotropic conductive film.

It should be noted that in above description, the technical solutions of the embodiments of the present disclosure are shown only by way of example, but it does not mean that the embodiments of the present disclosure are limited to above steps and structures. Where possible, the steps and structures can be adjusted and selected as needed. Therefore, some steps and units are not essential elements for implementing the overall inventive idea of the embodiments of the present disclosure.

So far, the present disclosure has been described in conjunction with the preferred embodiments. It should be understood that those skilled in the art can make various changes, substitutions and additions without departing from the spirit and scope of the embodiments of the present disclosure. Therefore, the scope of the embodiments of the present disclosure is not limited to above specific embodiments, but should be defined by the appended claims.

We claim:

1. A display substrate, comprising:

a base substrate comprising an active area and a peripheral area surrounding the active area;

a plurality of sub-pixels located in the active area;

a plurality of data lines located in the active area and extending in a first direction, wherein the plurality of data lines are electrically coupled to the plurality of sub-pixels;

a plurality of gate lines located in the active area and extending in a second direction, wherein the first direction intersects the second direction, and the plurality of gate lines are electrically coupled to the plurality of sub-pixels;

a gate driving circuit located in the peripheral area, and electrically coupled to the plurality of gate lines;

a first start-up voltage signal line, a first clock signal line, and a second clock signal line electrically coupled to the gate driving circuit;

a plurality of first pins located in the peripheral area;

a plurality of second pins located in the peripheral area and between the active area and the plurality of first pins;

a plurality of first array test pins located between the plurality of first pins and the plurality of second pins, wherein the plurality of first array test pins are electrically coupled respectively to a plurality of array test signal lines, and the plurality of array test signal lines comprise at least one of the first start-up voltage signal line, the first clock signal line, or the second clock signal line; and a plurality of second array test pins located between the plurality of first pins and the plurality of second pins and arranged in a direction along a boundary of the active area, wherein the plurality of first array test pins are located on at least one side of the plurality of second array test pins in the direction along the boundary of the active area, the plurality of second array test pins are electrically coupled to the plurality of data lines, and the plurality of the second array test pins are configured to receive array test data signals from the plurality of sub-pixels through the plurality of data lines.

2. The display substrate according to claim 1, wherein the plurality of array test signal lines comprise the first start-up voltage signal line, the first clock signal line, and the second clock signal line.

3. The display substrate according to claim 1, wherein the active area comprises a first boundary, a second boundary, a third boundary, and a fourth boundary coupled in sequence, and the plurality of first array test pins and the plurality of second array test pins are located in the peripheral area close to the first boundary;

the gate driving circuit comprises a first sub-circuit and a second sub-circuit, the first sub-circuit is located in the peripheral area close to the second boundary and the second sub-circuit is located in the peripheral area close to the fourth boundary;

the first start-up voltage signal line comprises a first sub-line of first start-up voltage signal line and a second sub-line of first start-up voltage signal line; the first clock signal line comprises a first sub-line of first clock signal line and a second sub-line of first clock signal line; the second clock signal line comprises a first sub-line of second clock signal line and a second sub-line of second clock signal line; the first sub-line of first start-up voltage signal line, the first sub-line of first clock signal line and the first sub-line of second clock signal line are located in the peripheral area close to the second boundary, and are electrically coupled to the first sub-circuit; and the second sub-line of first start-up voltage signal line, the second sub-line of first clock signal line, and the second sub-line of second clock signal line are located in the peripheral area close to the fourth boundary, and are electrically coupled to the second sub-circuit;

the plurality of first array test pins comprises a first group of first array test pins and a second group of first array test pins, and the first group of first array test pins and the second group of first array test pins are located respectively on both sides of the plurality of second array test pins in a direction along the first boundary; and wherein, the first sub-line of first start-up voltage signal line, the first sub-line of first clock signal line, and the first sub-line of second clock signal line are electrically coupled to the first group of first array test pins, and the second sub-line of first start-up voltage signal line, the second sub-line of first clock signal line, and the second sub-line of second clock signal line are electrically coupled to the second group of first array test pins.

4. The display substrate according to claim 1, further comprising:

a plurality of light-emitting control lines located in the active area and extending in the second direction, the plurality of light-emitting control lines are electrically coupled to the plurality of sub-pixels;

a light-emitting control driving circuit located in the peripheral area and on a side of the gate driving circuit away from the active area;

a second start-up voltage signal line, a third clock signal line, and a fourth clock signal line, wherein the light-emitting control driving circuit is electrically coupled to the second start-up voltage signal line, the third clock signal line, and the fourth clock signal line, and the plurality of array test signal lines further comprise at least one of the second start-up voltage signal line, the third clock signal line, or the fourth clock signal line.

5. The display substrate according to claim 4, wherein the plurality of array test signal lines further comprise the second start-up voltage signal line, the third clock signal line, and the fourth clock signal line.

6. The display substrate according to claim 4, wherein the active area comprises a first boundary, a second boundary, a third boundary, and a fourth boundary coupled in sequence, and the plurality of first array test pins and the plurality of second array test pins are located in the peripheral area close to the first boundary;

the light-emitting control driving circuit comprises a third sub-circuit and a fourth sub-circuit, the third sub-circuit is located in the peripheral area close to the second boundary and the fourth sub-circuit is located in the peripheral area close to the fourth boundary;

the second start-up voltage signal line comprises a first sub-line of second start-up voltage signal line and a second sub-line of second start-up voltage signal line; the third clock signal line comprises a first sub-line of third clock signal line and a second sub-line of third clock signal line; and the fourth clock signal line comprises a first sub-line of fourth clock signal line and a second sub-line of fourth clock signal line;

the first sub-line of second start-up voltage signal line, the first sub-line of third clock signal line, and the first sub-line of fourth clock signal line are located in the peripheral area close to the second boundary, and are electrically coupled to the third sub-circuit; and the second sub-line of second start-up voltage signal line, the second sub-line of third clock signal line, and the second sub-line of fourth clock signal line are located in the peripheral area close to the fourth boundary, and are electrically coupled to the fourth sub-circuit;

the plurality of first array test pins comprises a first group of first array test pins and a second group of first array test pins, and the first group of first array test pins and the second group of first array test pins are located respectively on both sides of the plurality of second array test pins; and wherein, the first sub-line of second start-up voltage signal line, the first sub-line of third clock signal line, and the first sub-line of fourth clock signal line are electrically coupled to the first group of first array test pins, and the second sub-line of second start-up voltage signal line, the second sub-line of third clock signal line, and the second sub-line of fourth clock signal line are electrically coupled to the second group of first array test pins.

7. The display substrate according to claim 1, further comprising:

a first selection signal line and a second selection signal line; and a multiplex circuit located between the plurality of second pins and the active area, wherein the multiplex circuit comprises a plurality of multiplex switches, at least one of the plurality of multiplex switches comprises a first transistor and a second transistor, a gate of the first transistor is electrically coupled to the first selection signal line, and a gate of the second transistor is electrically coupled to the second selection signal line; and wherein, the plurality of array test signal lines further comprise the first selection signal line and the second selection signal line.

8. The display substrate according to claim 7, wherein the first selection signal line comprises a first sub-line of first selection signal line and a second sub-line of first selection signal line, and the second selection signal line comprises a first sub-line of second selection signal line and a second sub-line of second selection signal line;

the plurality of first array test pins comprise a first group of first array test pins and a second group of first array test pins, and the first group of first array test pins and the second group of first array test pins are located respectively on both sides of the plurality of second array test pins; and wherein, the first sub-line of first selection signal line and the first sub-line of second selection signal line are electrically coupled to the first group of first array test pins, and the second sub-line of first selection signal line and the second sub-line of second selection signal line are electrically coupled to the second group of first array test pins.

9. The display substrate according to claim 1, further comprising: a plurality of initial voltage signal lines located in the active area and an initial voltage signal bus located in the peripheral area, wherein the initial voltage signal bus is located between the gate driving circuit and the active area, and the plurality of array test signal lines further comprise the initial voltage signal bus.

10. The display substrate according to claim 9, wherein the initial voltage signal bus comprises a first sub-line of initial voltage signal bus and a second sub-line of initial voltage signal bus, the first sub-line of initial voltage signal bus is located in the peripheral area close to the second boundary and the second sub-lines of initial voltage signal bus is located in the peripheral area close to the fourth boundary;

the plurality of first array test pins comprises a first group of first array test pins and a second group of first array test pins, and the first group of first array test pins and the second group of first array test pins are located respectively on both sides of the plurality of second array test pins; and wherein, the first sub-line of initial voltage signal bus is electrically coupled to the first group of first array test pins, and the second sub-line of initial voltage signal bus is electrically coupled to the second group of first array test pins.

11. The display substrate according to any claim 1, further comprising: a plurality of first power lines located in the active area and a first power bus located in the peripheral area close to the first boundary, wherein the plurality of first power lines are electrically coupled to the first power bus, and the plurality of array test signal lines further comprise the first power bus.

12. The display substrate according to claim 11, wherein the first power bus comprises a first sub-line of first power bus and a second sub-line of first power bus, and the first sub-line of first power bus and the second sub-line of first power bus are located respectively in the peripheral area close to the first boundary;

the plurality of first array test pins comprises a first group of first array test pins and a second group of first array test pins, and the first group of first array test pins and the second group of first array test pins are located respectively on both sides of the plurality of second array test pins; and wherein, the first sub-line of first power bus is electrically coupled to the first group of first array test pins, and the second sub-line of first power bus is electrically coupled to the second group of first array test pins.

13. The display substrate according to claim 1, further comprising:

a first switch signal line, a second switch signal line, a third switch signal line, and a fourth switch signal line;

a first cell test circuit located between the plurality of second pins and the active area, wherein the first cell test circuit comprises a plurality of first test sub-circuits, at least one of the plurality of first test sub-circuits comprises a third transistor, a fourth transistor, and a fifth transistor, and wherein a gate of the third transistor is electrically coupled to the first switch signal line, a gate of the fourth transistor is electrically coupled to the second switch signal line, and a gate of the fifth transistor is electrically coupled to the third switch signal line; and a second cell test circuit located between the plurality of second pins and the first cell test circuit, wherein the second cell test circuit comprises a plurality of second test sub-circuits, at least one of the plurality of second test sub-circuits comprises a sixth transistor, and a gate of the sixth transistor is electrically coupled to the fourth switch signal line;

wherein, the plurality of array test signal lines further comprise the first switch signal line, the second switch signal line, the third switch signal line, and the fourth switch signal line.

14. The display substrate according to claim 13, wherein the first switch signal line comprises a first sub-line of first switch signal line and a second sub-line of first switch signal line, the second switch signal line comprises a first sub-line of second switch signal line and a second sub-line of second switch signal line, the third switch signal line comprises a first sub-line of third switch signal line and a second sub-line of third switch signal line, and the fourth switch signal line comprises a first sub-line of fourth switch signal line and a second sub-line of fourth switch signal line;

the plurality of first array test pins comprises a first group of first array test pins and a second group of first array test pins, and the first group of first array test pins and the second group of first array test pins are located respectively on both sides of the plurality of second array test pins; and the first sub-line of first switch signal line, the first sub-line of second switch signal line, the first sub-line of third switch signal line, and the first sub-line of fourth switch signal line are electrically coupled to the first group of first array test pins, and the second sub-line of first switch signal line, the second sub-line of second switch signal line, the second sub-line of third switch signal line and the second sub-line of fourth switch signal line are electrically coupled to the second group of first array test pins.

15. The display substrate according to claim 1, wherein at least a part of the plurality of array test signal lines are coupled in one-to-one correspondence with a part of the plurality of second pins, and the part of the plurality of second pins are coupled in one-to-one correspondence with at least a part of the plurality of first array test pins through a plurality of first connection lines, wherein the at least a part of the plurality of array test signal lines comprises the first start-up voltage signal line, the first clock signal line, the second clock signal line, a second start-up voltage signal line, a third clock signal line, a fourth clock signal line, a first selection signal line, a second selection signal line, and an initial voltage signal bus.

16. The display substrate according to claim 15, wherein the other part of the plurality of array test signal lines are coupled in one-to-one correspondence with the other part of the plurality of first array test pins through a plurality of second connection lines, and wherein the other part of the plurality of array test signal lines comprises a first switch signal line, a second switch signal line, a third switch signal line, a fourth switch signal line, and a first power bus.

17. The display substrate according to claim 1, further comprising an electrostatic discharge circuit, wherein the electrostatic discharge circuit comprises a plurality of electrostatic discharge units located between the plurality of first array test pins and the plurality of second pins and coupled in one-to-one correspondence with the plurality of first array test pins, wherein each of the electrostatic discharge units comprises a seventh transistor and an eighth transistor, a gate and a first electrode of the seventh transistor are coupled to a high voltage signal line, a second electrode of the eighth transistor is coupled to a low voltage signal line, and a second electrode of the seventh transistor and a gate and a first electrode of the eighth transistor are electrically coupled to the first array test pins, and wherein the plurality of first array test pins and the plurality of second array test pins are arranged in one or more rows in the direction along the boundary of the active area.

18. The display substrate according to claim 1, wherein at least one of the plurality of sub-pixels comprises a driving thin film transistor and a storage capacitor, and wherein:

the driving thin film transistor comprises a driving active layer located on the base substrate, a driving gate located on a side of the driving active layer away from the base substrate, a gate insulating layer located on a side of the driving gate away from the base substrate, an interlayer dielectric layer located on a side of the gate insulating layer away from the base substrate, and a driving source and a driving drain located on a side of the interlayer dielectric layer away from the base substrate;

the storage capacitor comprises a first capacitor electrode and a second capacitor electrode, the first capacitor electrode is located in the same layer as the driving gate, and the second capacitor electrode is located between the gate insulating layer and the interlayer dielectric layer;

at least one layer of the plurality of first array test pins and the plurality of second array test pins is located in the same layer as driving sources and driving drains of the plurality of sub-pixels in the active area;

the plurality of first connection lines are located in the same layer as driving sources and driving drains of the plurality of sub-pixels in the active area; and each of the plurality of second connection lines has a part located in the same layer as driving sources and driving drains of the plurality of sub-pixels in the active area, and a part located in the same layer as driving gates of the plurality of sub-pixels in the active area.

19. The display substrate according to claim 1, further comprising an anisotropic conductive film covering the plurality of first array test pins and the plurality of second array test pins.

20. A display panel comprising the display substrate according to claim 1.

* * * * *